US012455109B2

(12) United States Patent
Frattini et al.

(10) Patent No.: US 12,455,109 B2
(45) Date of Patent: Oct. 28, 2025

(54) WATER ROUTING FROM CABINET TO DOOR OF A REFRIGERATOR WITH ARTICULATED HINGE

(71) Applicant: WHIRLPOOL CORPORATION, Benton Harbor, MI (US)

(72) Inventors: Gustavo Frattini, St. Joseph, MI (US); Sarah M. Galea, St. Joseph, MI (US); Daniel E. Lottinville, Stevensville, MI (US); Vikas C. Mruthyunjaya, St. Joseph, MI (US); Abhay Naik, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 344 days.

(21) Appl. No.: 18/129,586

(22) Filed: Mar. 31, 2023

(65) Prior Publication Data

US 2023/0235946 A1 Jul. 27, 2023

Related U.S. Application Data

(62) Division of application No. 15/733,612, filed as application No. PCT/US2018/038525 on Jun. 20, 2018, now Pat. No. 11,644,231.

(51) Int. Cl.
*F25C 5/00* (2018.01)
*F25C 5/20* (2018.01)
(Continued)

(52) U.S. Cl.
CPC ..... *F25D 23/028* (2013.01); *F25C 5/22* (2018.01); *F25D 11/02* (2013.01); *F25D 23/087* (2013.01);
(Continued)

(58) Field of Classification Search
CPC ..... F25D 11/02; F25D 23/028; F25D 23/087; F25D 23/126; F25D 2323/021;
(Continued)

(56) References Cited

U.S. PATENT DOCUMENTS 3,788,094 A 1/1974 Benasutti et al.
3,830,406 A 8/1974 Robb
(Continued)

FOREIGN PATENT DOCUMENTS

CN 1683887 A 10/2005
CN 1940423 A 4/2007
(Continued)

*Primary Examiner* — Filip Zec
(74) *Attorney, Agent, or Firm* — Price Heneveld LLP

(57) ABSTRACT

A refrigerator comprising: a cabinet; a door operably connected to the cabinet, the door having a closed position relative to the cabinet and an opened position relative to the cabinet, and the door transitions from the closed position to the opened position in a non-circular path; a liquid outlet disposed at the cabinet; and a liquid receiver disposed at the door, the liquid receiver configured to receive liquid exiting the liquid outlet when the door is in the closed position but not in the opened position. The refrigerator can further include a gasket adjacent to the liquid receiver and a gasket adjacent to the liquid outlet. When the door is in the closed position, the gasket of the door can cooperate with the gasket of the cabinet to form a sealed channel to seal liquid transfer from the liquid outlet to the liquid receiver for use at the door.

20 Claims, 17 Drawing Sheets

(51) Int. Cl.
*F25D 11/02* (2006.01)
*F25D 23/02* (2006.01)
*F25D 23/08* (2006.01)

(52) U.S. Cl.
CPC .. *F25D 2323/021* (2013.01); *F25D 2323/024* (2013.01); *F25D 2323/121* (2013.01)

(58) Field of Classification Search
CPC ..... F25D 2323/024; F25D 2323/121; F25D 2323/122; F25C 5/22
See application file for complete search history.

(56) References Cited

U.S. PATENT DOCUMENTS 4,912,942 A 4/1990 Katterhenry et al.
5,263,509 A * 11/1993 Cherry ..... F25D 23/126 312/401
5,560,393 A * 10/1996 Clack ..... B67D 3/0009 137/562
6,613,236 B1 * 9/2003 Guess ..... B01D 35/143 62/338
6,681,585 B1 1/2004 Stagg et al.
6,973,803 B2 12/2005 Olive et al.
8,267,492 B2 9/2012 Lucas et al.
8,382,219 B2 * 2/2013 Hottmann ..... A47B 88/46 312/348.4
8,499,577 B2 8/2013 Watson et al.
8,826,944 B1 * 9/2014 Laine ..... F25D 23/126 138/109
8,833,100 B2 9/2014 Meyerholtz et al.
8,925,344 B2 1/2015 Mitchell et al.
9,072,422 B2 * 7/2015 Kozinski ..... A47L 15/4261
9,085,453 B2 7/2015 McMahan et al.
9,115,928 B2 8/2015 Akalan et al.
9,267,721 B2 2/2016 Hunter
9,322,590 B1 * 4/2016 Phillips ..... F25D 29/006
9,328,954 B2 5/2016 Kang et al.
9,593,518 B2 3/2017 Downs et al.
9,663,343 B2 5/2017 Veldhi et al.
9,823,011 B2 11/2017 Kempte
9,851,137 B2 12/2017 Tenbarge
10,030,906 B2 7/2018 Hall et al.
10,228,184 B2 * 3/2019 Crompton ..... F25D 23/126
10,323,876 B2 6/2019 Jeong et al.
10,401,076 B2 9/2019 Platt
10,513,213 B1 * 12/2019 Mullenaux ..... B67D 1/0858
10,739,063 B2 * 8/2020 Shi ..... F25D 23/04
10,788,252 B2 * 9/2020 Mitchell ..... F25C 1/243
10,794,628 B2 10/2020 Park et al.
2005/0268639 A1 12/2005 Hortin et al.
2006/0086127 A1 4/2006 Anselmino et al.
2007/0204647 A1 9/2007 Puthiyaveetil et al.
2008/0173027 A1 7/2008 Kim et al.
2009/0007585 A1 1/2009 Kim et al.
2009/0077995 A1 3/2009 Ihle et al.
2009/0314012 A1 12/2009 Lim et al.
2010/0283359 A1 * 11/2010 Hottmann ..... A47B 88/95 312/294
2010/0307184 A1 * 12/2010 Jung ..... F25D 23/126 62/449
2011/0113816 A1 5/2011 Stocker
2013/0047656 A1 2/2013 Kang et al.
2013/0063011 A1 * 3/2013 Kozinski ..... E05F 5/02 312/319.2
2017/0003069 A1 1/2017 Moertl et al.
2019/0219318 A1 * 7/2019 Lercher ..... F25D 23/126
2021/0041158 A1 2/2021 Frattini et al.

FOREIGN PATENT DOCUMENTS

CN 101074822 A 11/2007
CN 107131700 A 9/2017
CN 107850374 A 3/2018
CN 102472548 A 5/2021
DE 102010039379 A1 3/2011
DE 102016214833 A1 2/2018
EP 1191289 A2 3/2002
EP 2770280 A2 8/2014
FR 1168048 A 12/1958
IN 1629578 A 6/2005
KR 1020100081038 A 7/2010
KR 1020170067705 6/2017
WO 2005073124 A2 8/2005
WO 2006120070 A1 11/2006

* cited by examiner

WATER ROUTING FROM CABINET TO DOOR OF A REFRIGERATOR WITH ARTICULATED HINGE

CROSS-REFERENCE TO RELATED APPLICATIONS

This application is a division of U.S. application Ser. No. 15/733,612, filed on Sep. 15, 2020, now U.S. Pat. No. 11,644,231, entitled "WATER ROUTING FROM CABINET TO DOOR OF A REFRIGERATOR WITH ARTICULATED HINGE," which is a National Stage Entry of International Application No. PCT/US2018/038525, filed on Jun. 20, 2018, entitled "WATER ROUTING FROM CABINET TO DOOR OF A REFRIGERATOR WITH ARTICULATED HINGE," the disclosures of which are hereby incorporated herein by reference in their entirety.

BACKGROUND OF THE DISCLOSURE

The present disclosure generally relates to the transport of liquid, such as water, from the cabinet of a refrigerator or other appliance to a door of that refrigerator or other appliance when the door opens relative to the cabinet in a non-circular manner, such that the use of common tubing to transport the liquid is impractical.

In a refrigerator or other appliance having a door mounted dispensing apparatus for liquid (such as water) and/or ice, there is a need to transfer the liquid from the cabinet to the door. In some instances, liquid is transferred to the door from the cabinet in a number of ways, such as tubing through the hinge, through the edge of the door, or adjacent to the hinge. However, the use of articulated hinges which permit the door to open in a non-circular path that pushes the door away from the cabinet makes these traditional tubing options ineffective or less desirable. Therefore, a need has been identified in the art to provide a means for routing liquid from a cabinet to a door mounted dispenser when the door opens in a non-circular path.

SUMMARY OF THE DISCLOSURE

One aspect of this disclosure is a refrigerator that comprises: a cabinet; a door operably connected to the cabinet, the door having a closed position relative to the cabinet and an opened position relative to the cabinet, and the door transitions from the closed position to the opened position in a non-circular path; a liquid outlet disposed at the cabinet; and a liquid receiver disposed at the door, the liquid receiver configured to receive liquid exiting the liquid outlet when the door is in the closed position but not in the opened position. The cabinet can include a fresh food compartment. The door can allow access into the fresh food compartment when the door is in the opened position. The liquid outlet can be disposed within the fresh food compartment. The door can include a liquid dispenser in communication with the liquid receiver. The liquid dispenser can be configured to dispense liquid from the door while the door is in the closed position. The liquid receiver can be disposed vertically below the liquid outlet of the cabinet when the door is in the closed position. The door can further include a gasket adjacent to the liquid receiver. The cabinet can further include a gasket adjacent to the liquid outlet. When the door is in the closed position, the gasket of the door can cooperate with the gasket of the cabinet to form a sealed channel extending through both the gasket of the cabinet and the gasket of the door. As the door transitions from the closed position to the opened position, the gasket of the door can slide against the gasket of the cabinet. The cabinet can further include a tank that stores liquid received from a source external to the refrigerator. The liquid outlet can be in communication with the tank via tubing. A false wall can cover at least a portion of the tubing adjacent the liquid outlet. The cabinet can further include a freezer compartment, an ice maker in the freezer compartment, and a valve that selectively diverts liquid received from the source external to the refrigerator to either the tank or the ice maker in the freezer compartment. The cabinet can further include at least one one-way valve between the tank and the liquid outlet, the one-way valve permitting flow only toward the liquid outlet from the tank. The door can include a pump in communication with the liquid receiver. The liquid receiver can include a reservoir that collects liquid expelled from the liquid outlet of the cabinet. The pump can cause the transport of the liquid collected in the reservoir. The door can include a filter in communication with the liquid receiver that filters the liquid that the liquid receiver receives from the liquid outlet of the cabinet. The door can further include a liquid dispenser that dispenses liquid filtered by the filter. The door can further include an ice maker that makes ice from liquid filtered by the filter. The door can further include a valve disposed in liquid communication between the filter and both the ice maker and the liquid dispenser that selectively diverts liquid to either the ice maker or the liquid dispenser. The refrigerator can further include one or more articulated hinges that operably connect the door to the cabinet and that move the door away from the cabinet when the door transitions from the closed position to the opened position.

Another aspect of this disclosure is a refrigerator comprising: a cabinet including a liquid outlet configured to eject liquid and a gasket cooperating with the liquid outlet; and a door connected to the cabinet via one or more articulated hinges that move the door away from the cabinet when the door transitions from a closed position to an opened position relative to the cabinet, the door including: a liquid receiver configured to receive liquid ejected from the liquid outlet when the door is in the closed position but not in the opened position; a gasket cooperating with the liquid receiver; and a liquid dispenser in communication with the liquid receiver and configured to dispense liquid received from the liquid receiver; wherein, when the door is in the closed position, the gasket of the door cooperates with the gasket of the cabinet to form a sealed channel extending through both the gasket of the door and the gasket of the cabinet. The liquid receiver can be disposed vertically below the liquid outlet, when the door is in the closed position. The gasket cooperating with the liquid receiver can be disposed vertically below the gasket cooperating with the liquid outlet, when the door is in the closed position. As the door transitions from the closed position to the opened position, the gasket of the door can slide against the gasket of the cabinet and the sealed channel loses form. The door can further include a pump in communication with the liquid receiver, and the pump can be configured to pump liquid received by the liquid receiver to and through the liquid dispenser.

Another aspect of this disclosure is a refrigerator that comprises: a cabinet including a liquid outlet configured to eject liquid and a gasket cooperating with the liquid outlet; and a door connected to the cabinet via one or more articulated hinges that move the door away from the cabinet when the door transitions from a closed position to an opened position relative to the cabinet. The door includes: a liquid receiver configured to receive liquid ejected from the liquid outlet when the door is in the closed position but not in the opened position; gasket cooperating with the liquid receiver; a filter in fluid communication with the liquid receiver configured to filter the liquid received by the liquid receiver; a liquid dispenser in fluid communication with the filter and configured to dispense liquid filtered by the filter; an ice maker in fluid communication with the filter and configured to make ice from liquid filtered by the filter; and a valve disposed in fluid communication between the filter and both the ice maker and the liquid dispenser configured to selectively divert liquid to either the ice maker or the liquid dispenser. When the door is in the closed position, the gasket of the door cooperates with the gasket of the cabinet to form a sealed channel extending through both the gasket of the door and the gasket of the cabinet.

Another aspect of this disclosure is a refrigerator comprising: a cabinet; a door operably connected to the cabinet, the door having a closed position relative to the cabinet and an opened position relative to the cabinet; and a liquid line to transport liquid from the cabinet to the door, the liquid line including a door portion disposed at the door and a cabinet portion disposed at the cabinet; wherein, the liquid line is stretchable from a relaxed state to a stretched state, the liquid line is in the relaxed state when the door is in the closed position, the liquid line is in the stretched state when the door is in the opened position, and the liquid line is longer in the stretched state than in the relaxed state. The liquid line can be at least twice as long in the stretched state than the liquid line is in the relaxed state. The liquid line can transform from the relaxed state into the stretched state as the door moves from the closed position to the opened position. The liquid line can transform from the stretched state into the relaxed state as the door moves from the opened position to the closed position. The cabinet can include a fresh food compartment. The door can allow access into the fresh food compartment when the door is in the opened position. The cabinet portion of the liquid line can be disposed within the fresh food compartment. The door can include a liquid dispenser in communication with the liquid line. The liquid dispenser can be configured to dispense liquid from the door while the door is in the closed position. The cabinet portion of the liquid line can be at the same level as the door portion. When the door is in the closed position, the liquid line can be disposed in a linear path between the cabinet portion and the door portion. The cabinet can further including a tank that stores liquid received from a source external to the refrigerator. The liquid line can be in communication with the tank. A false wall can cover at least a portion of the cabinet portion of the liquid line. The cabinet can further include a freezer compartment, an ice maker in the freezer compartment, and a valve that selectively diverts liquid received from the source external to the refrigerator to either the tank or the ice maker in the freezer compartment. The cabinet can further include a one-way valve between the tank and the liquid line between the door and the cabinet. The one-way valve can permit liquid flow only toward the liquid line from the tank. The door can include a filter in communication with the liquid line that filters the liquid that the liquid line transports to the door. The door can further include a liquid dispenser that dispenses liquid filtered by the filter. The door can further include an ice maker that makes ice from liquid filtered by the filter. A valve can be disposed in communication between the filter and both the ice maker and the liquid dispenser that selectively diverts liquid to either the ice maker or the liquid dispenser. One or more articulated hinges can operably connect the door to the cabinet and move the door away from the cabinet when the door transitions from the closed position to the opened position.

Another aspect of this disclosure is a refrigerator comprising: a cabinet; a door operably connected to the cabinet, the door having a closed position relative to the cabinet and an opened position relative to the cabinet; a liquid line to transport liquid from the cabinet to the door; and a retractor operably coupled to the liquid line that releases a released portion of the liquid line when the door moves from the closed position to the opened position and retracts the released portion of the liquid line when the door moves from the opened position to the closed position, the liquid line having an exposed portion between the door and the retractor when the door is in the closed position. The released portion of the liquid line that is released from the retractor when the door moves from the closed position to the opened position can be at least twice as long as the exposed portion of the liquid line when the door is in the closed position. The cabinet can include a fresh food compartment. The door can allow access into the fresh food compartment when the door is in the opened position. The retractor can be disposed within the fresh food compartment. The door can include a liquid dispenser in communication with the liquid line. The liquid dispenser can be configured to dispense liquid from the door while the door is in the closed position. Movement of the door from the closed position to the opened position can impart a pulling force extracting the released portion of the liquid line from the retractor. The retractor includes a recoil spring that imparts a retracting force upon the liquid line, such that when the door moves toward the closed position, the released portion of the liquid line retracts. The retractor can include a housing into which the released portion of the liquid line retracts when the door moves from the opened position to the closed position. The retractor can further include a recoil spring housed within the housing that imparts a retracting force upon the liquid line, such that when the door moves toward the closed position, the released portion of the liquid line retracts. When the door is in the closed position, the liquid line can be disposed in a linear path between the door and the retractor. The cabinet can further include a tank that stores liquid received from a source external to the refrigerator. The liquid line can be in communication with the tank. A false wall can cover the retractor. The cabinet can further include a freezer compartment, an ice maker in the freezer compartment, and a valve that selectively diverts liquid received from the source external to the refrigerator to either the tank or the ice maker in the freezer compartment. The cabinet can further include a one-way valve between the tank and the liquid line between the door and the cabinet, the one-way valve permitting liquid flow only toward the liquid line from the tank. The door can include a filter in communication with the liquid line that filters the liquid that the liquid line transports to the door. The door can further include a liquid dispenser that dispenses liquid filtered by the filter. The door can further include an ice maker that makes ice from liquid filtered by the filter. The door can further include a valve disposed in communication between the filter and both the ice maker and the liquid dispenser that selectively diverts liquid to either the ice maker or the liquid dispenser. One or more articulated hinges can operably connect the door to the cabinet and that move the door away from the cabinet when the door transitions from the closed position to the opened position.

These and other features, advantages, and objects of the present disclosure will be further understood and appreciated by those skilled in the art by reference to the following specification, claims, and appended drawings.

BRIEF DESCRIPTION OF THE DRAWINGS

Further advantages and features according to the present disclosure will become clear from the following detailed description provided as a non-limiting example, with reference to the attached drawings in which.

Figure 1:
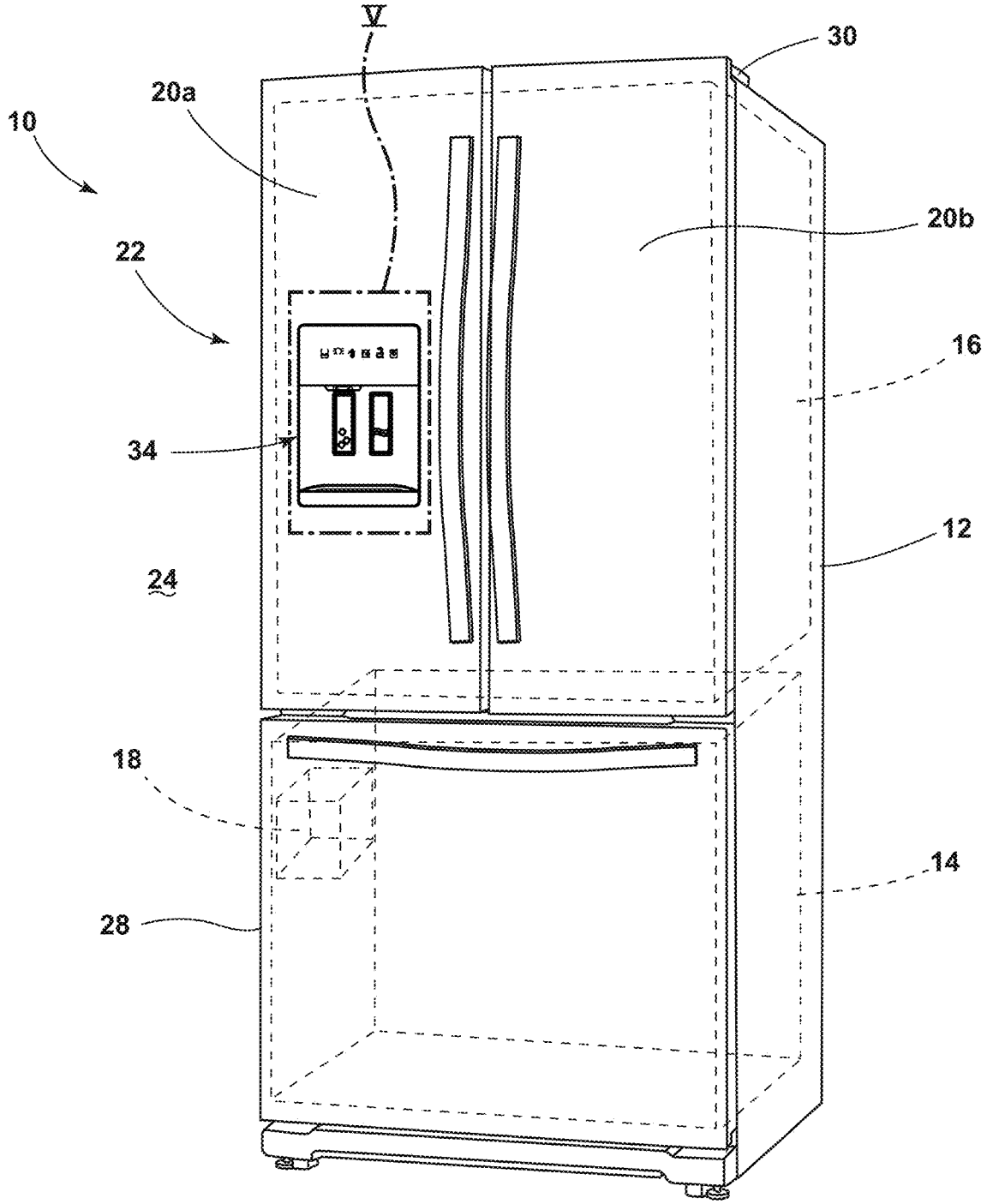
FIG. 1 is a perspective view of an embodiment of a refrigerator with a dispenser assembly including a water dispenser disposed at a door, which is operably connected to a cabinet.

The components in the figures are not necessarily to scale, emphasis instead being placed upon illustrating the principles described herein.

DETAILED DESCRIPTION

The present illustrated embodiments reside primarily in combinations of apparatus components related to a refrigerator. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Figure 2:
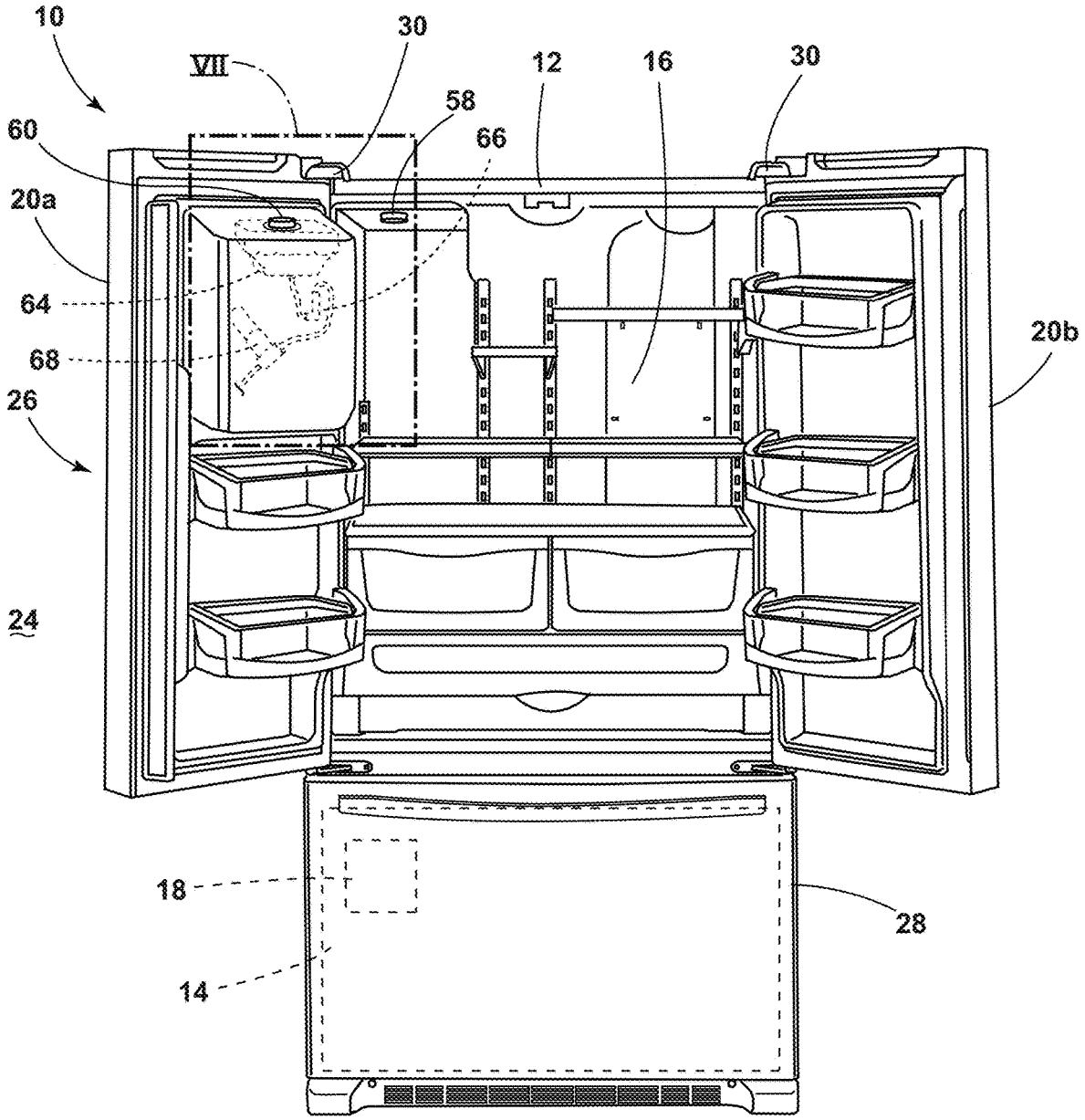
FIG. 2 is a front view (from the perspective of a user) of the refrigerator of FIG. 1, illustrating the door with the dispenser assembly in an opened position and connected to the cabinet via an articulated hinge.

With reference to FIG. 1, a refrigerator 10 of the present disclosure is illustrated. In general, the refrigerator 10 maintains a sufficiently cool internal environment to store food and beverages in order to slow-down deterioration of the food and beverages, as compared to ambient temperature. The refrigerator 10 includes a cabinet 12. The cabinet 12 houses one or more compartments, such a freezer compartment 14 and a fresh food compartment 16. The freezer compartment 14 generally provides a temperature controlled environment to store foods at a below freezing temperature. The freezer compartment 14 can include an ice maker 18. The fresh food compartment 16 generally provides a temperature controlled environment to store foods and beverages as a temperature above freezing temperature but below ambient temperature in order to prolong the freshness of the stored foods and beverages. The refrigerator 10 includes one or more doors 20*a*, 20*b* operably connected to the cabinet 12 to provide selective access to the fresh food compartment 16. For example, doors 20*a* have a closed position 22 (FIG. 1) relative to the cabinet 12 wherein access into the fresh food compartment 16 from a position external 24 to the refrigerator 10 is denied. In addition, doors 20*a*, 20*b* have an opened position 26 (FIG. 2) relative to the cabinet 12 wherein access into the fresh food compartment 16 from the position external 24 to the refrigerator 10 is allowed. Similarly, a freezer drawer 28 provides selective access to the freezer compartment 14 from the position external 24. The refrigerator 10 illustrated has a bottom mount freezer compartment 14 with French doors 20*a*, 20*b* to the fresh food compartment 16 above the freezer compartment 14. However, it should be understood that other configurations of freezer drawers 28, doors 20, and compartments 14, 16 can be utilized instead without deviating from the concepts set forth in this disclosure. For example, the refrigerator 10 may have only the fresh food compartment 16 with no freezer compartment 14 and only one door 20 providing selective access to the fresh food compartment 16. As another example, the refrigerator 10 may have a freezer compartment 14 disposed side-by-side with the fresh food compartment 16, each having a dedicated door 20 to provide selective access.

Figure 3:
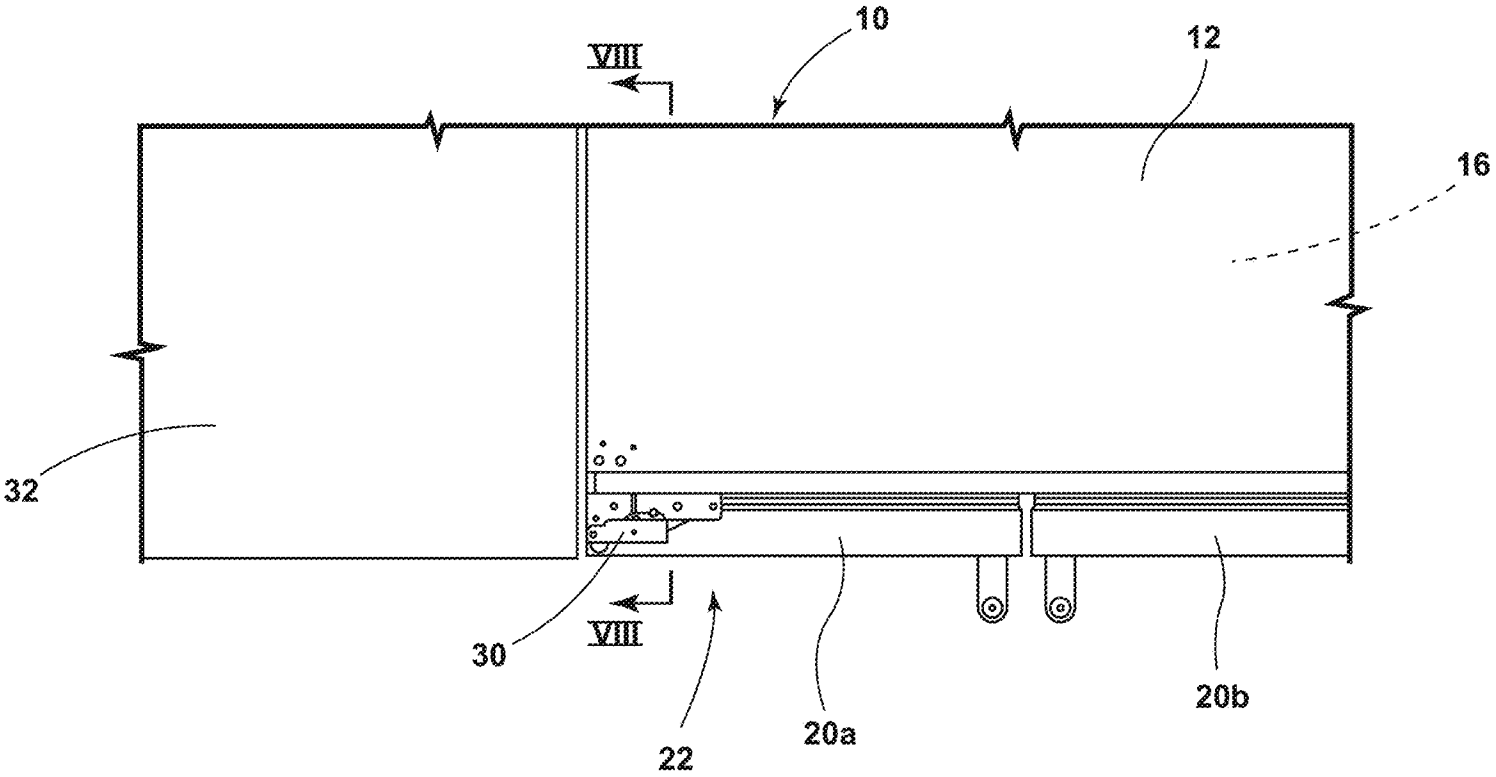
FIG. 3 is a top view of the refrigerator of FIG. 1, illustrating the door flush with cabinetry when the door is in a closed position relative to the cabinet.
Figure 4:
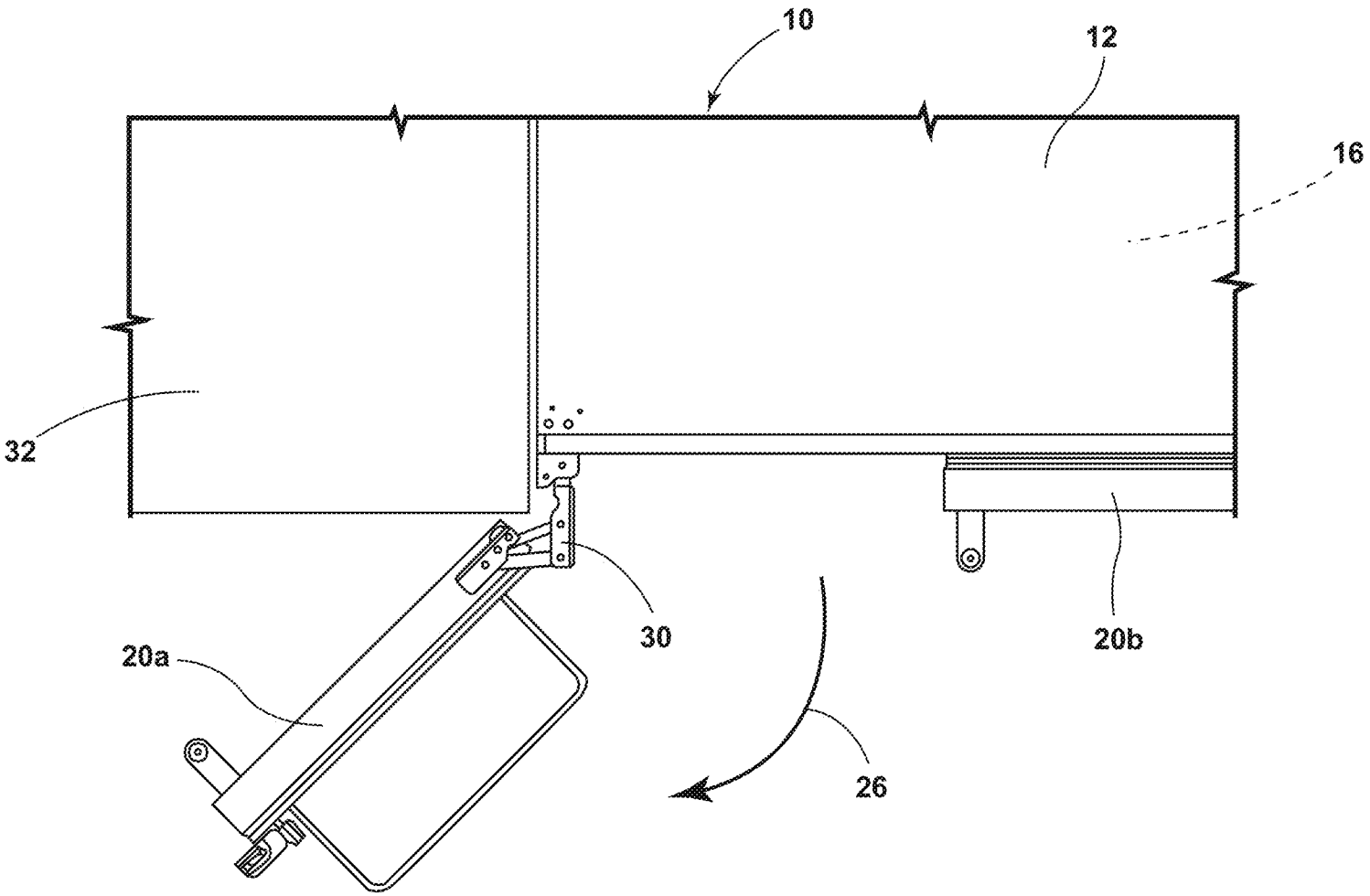
FIG. 4 is a top view of the refrigerator of FIG. 1, illustrating the door in the opened position and the articulated hinge pushing the door away from the cabinet to allow the door to be in the opened position despite the presence of the adjacent cabinetry.

Referring now to FIGS. 3 and 4, in an embodiment of the refrigerator 10, the doors 20*a*, 20*b* are operably connected to the cabinet 12 via articulated hinges 30. The articulated hinge 30 allows the door 20*a* in the closed position 22 to be flush with an object, such as cabinetry 32, that is directly adjacent the refrigerator 10. Without the articulated hinge 30, moving the door 20*a* from the closed position 22 to the opened position 26 in a typically circular path would result in the cabinetry 32 interfering with the opening of the door 20*a*. However, the articulated hinge 30 allows the door 20*a* to transition from the closed position 22 to the opened position 26 in a non-circular path, i.e., the articulated hinge 30 moves the door 20*a* away from the cabinet 12 of the refrigerator 10 as the door 20*a* transitions from the closed position 22 to the opened position 26. The articulated hinge 30 thus permits the door 20*a* to move to a fully opened position 26 without contacting the cabinetry 32 that is adjacent the refrigerator 10.

Figure 5:
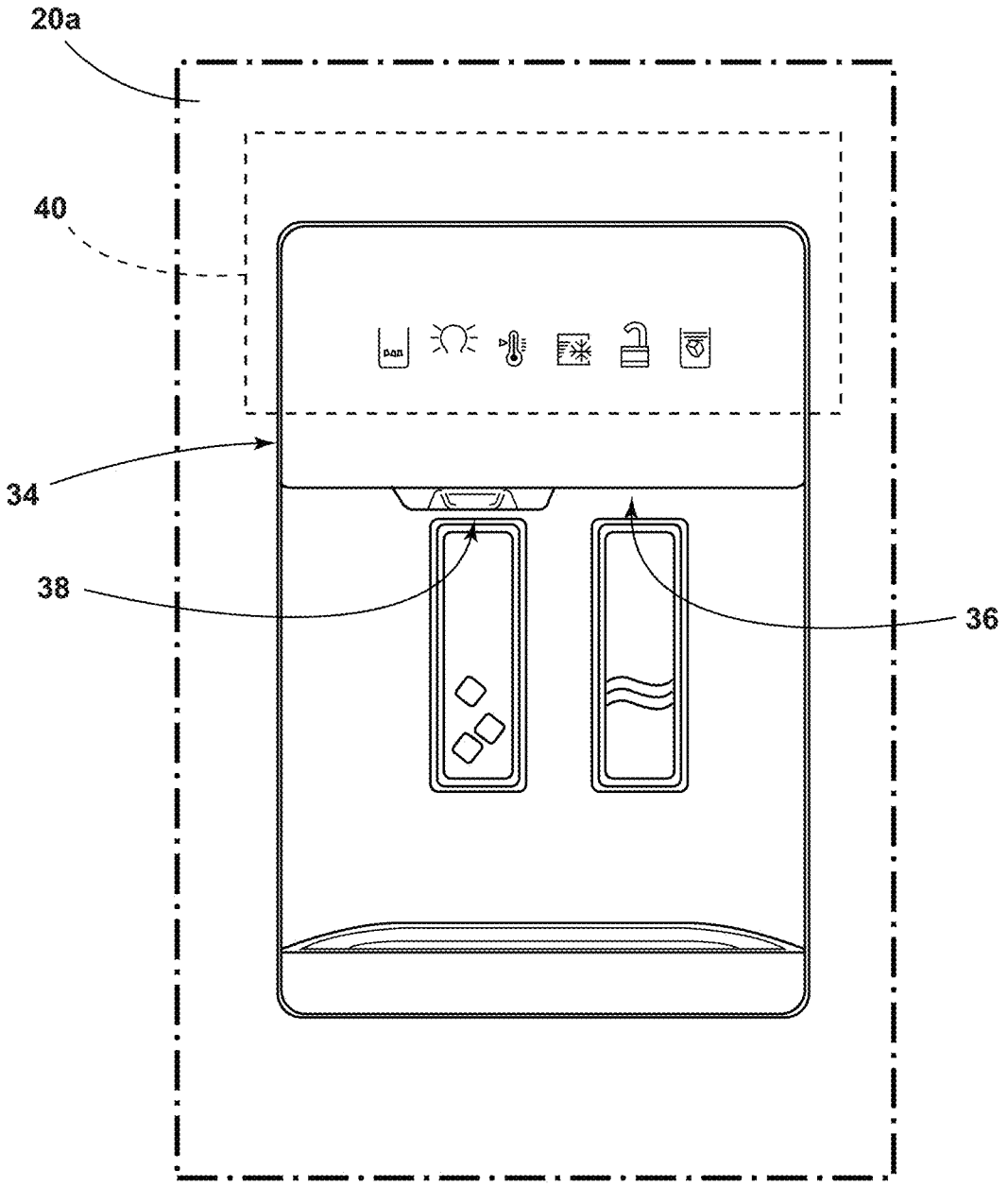
FIG. 5 is a close up front view of area V from FIG. 1, illustrating the dispensing apparatus at the door, which includes a liquid dispenser (such as to dispense water) and an ice dispenser.

Referring now additionally to FIG. 5, the door 20*a* includes a dispenser assembly 34, which can include one or more of a liquid dispenser 36 and an ice dispenser 38. The dispenser assembly 34 allows a user (not illustrated) to dispense liquid, such as water, from the door 20*a* at the liquid dispenser 36 and ice from the ice dispenser 38 while the door 20*a* is the closed position 22 and without the need to access either the fresh food compartment 16 or the freezer compartment 14. The liquid can be dispensed at the liquid dispenser 36 upon command from the user. The door 20*a* of the illustrated embodiment further includes an ice maker 40 that makes the ice that the ice dispenser 38 dispenses.

Figure 6:
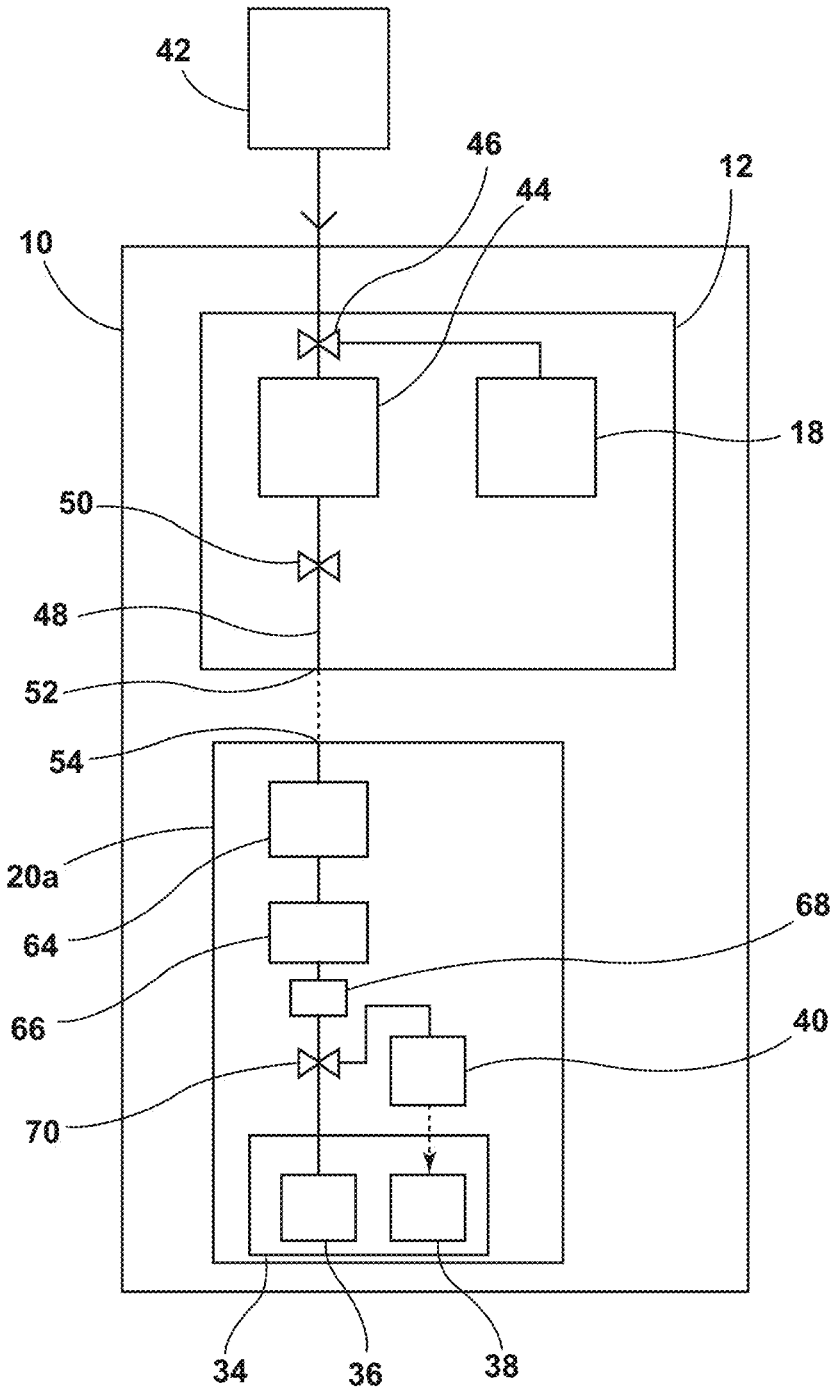
FIG. 6 is a schematic diagram of flow from a source external to the refrigerator of FIG. 1, through the cabinet to a liquid outlet at the cabinet, from the liquid outlet to a liquid receiver at the door, and through the door to the dispensing apparatus.

Referring now additionally to FIG. 6, the liquid that the liquid dispenser 36 dispenses and the ice that the ice dispenser 38 dispenses originates from a source 42 external to the refrigerator 10. The cabinet 12 can include a tank 44 that stores a volume of the liquid (such as water) received from the source 42 (such as a water line within a residence or other building) external to the refrigerator 10. The refrigerator 10 can include a valve 46 in fluid communication between the tank 44 and the source 42 to selectively divert liquid to the ice maker 18 in the freezer compartment 14. In other words, the valve 46 selectively diverts liquid received from the source 42 external to the refrigerator 10 to either the tank 44 or the ice maker 18 in the freezer compartment 14. Liquid from the tank 44 can transport through tubing 48 within the cabinet 12. A one-way valve 50 prevents liquid transporting through the tubing 48 from transporting back to the tank 44. For the liquid dispenser 36 to dispense liquid that originates from the source 42, or for the ice dispenser 38 to dispense ice made from the liquid that originates from the source 42, the liquid transporting through the tubing 48 in the cabinet 12 must additionally be transported between the tubing 48 in the cabinet 12 and the door 20*a* and thereafter within the door 20*a* to the liquid dispenser 36 or to the ice maker 40 that generates the ice that the ice dispenser 38 dispenses. In part because the door 20*a* is operably connected to the cabinet 12 via the articulated hinge 30, which moves the door away from the cabinet 12, typical tubing cannot advantageously be routed from the cabinet 12 to the door 20*a*.

Figure 7:
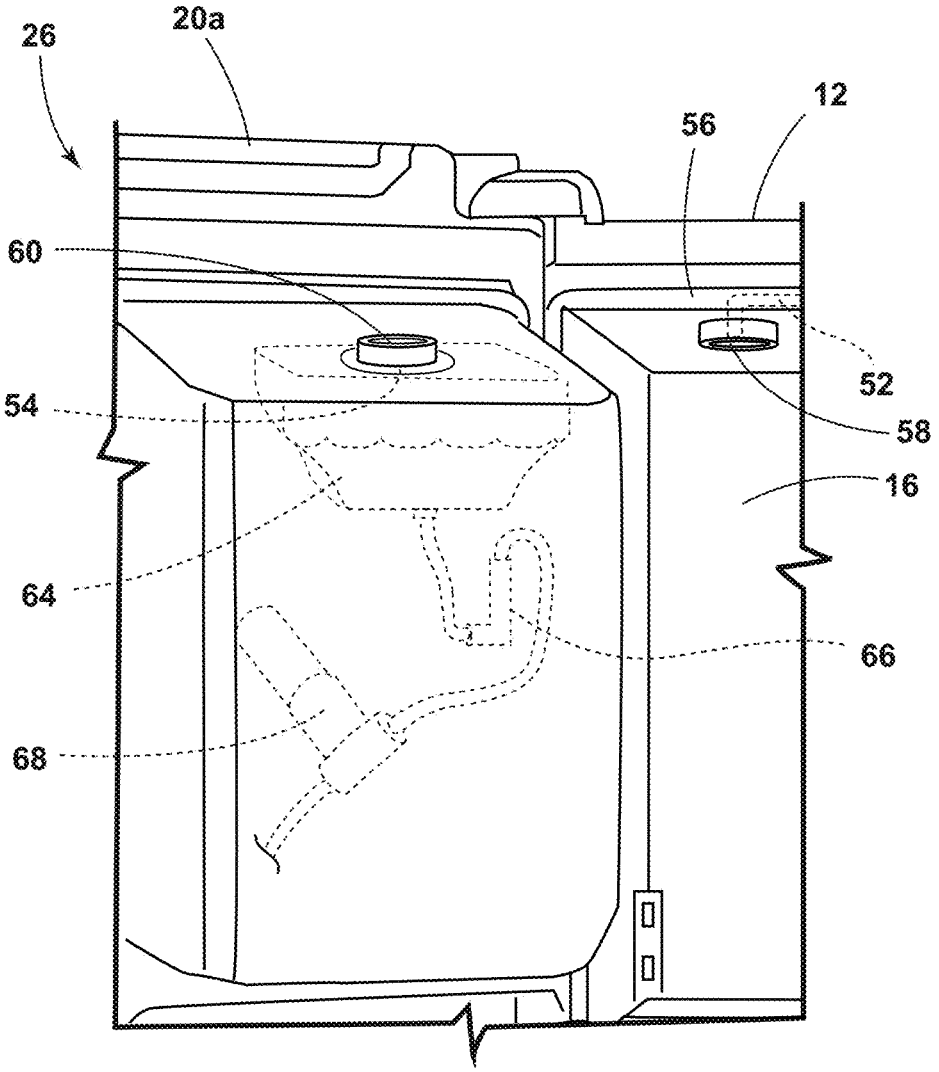
FIG. 7 is a close up perspective view of area VII of FIG. 2, illustrating the door in the opened position, with the liquid outlet of the cabinet and a cooperating gasket not engaged with a liquid receiver and a cooperating gasket at the door.
Figure 8:
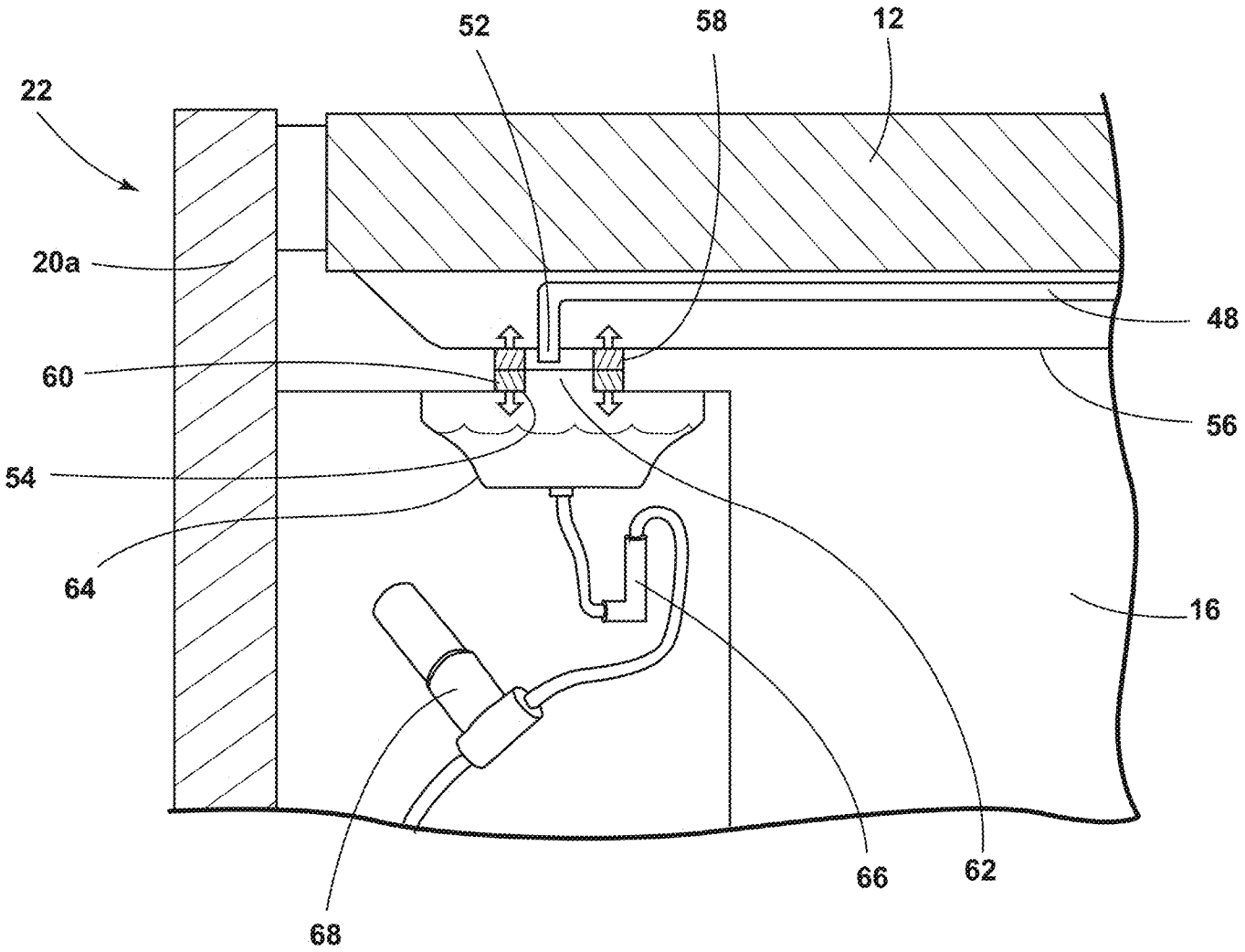
FIG. 8 is a side view of the refrigerator of FIG. 1 taken along cross-section VIII-VIII of FIG. 3 with the door in the closed position, illustrating the liquid outlet at the cabinet and cooperating gasket lined up with and cooperating with the liquid receiver and cooperating gasket at the door, the gaskets forming a sealed channel for the flow of liquid from the liquid outlet to the liquid receiver.
Figure 9:
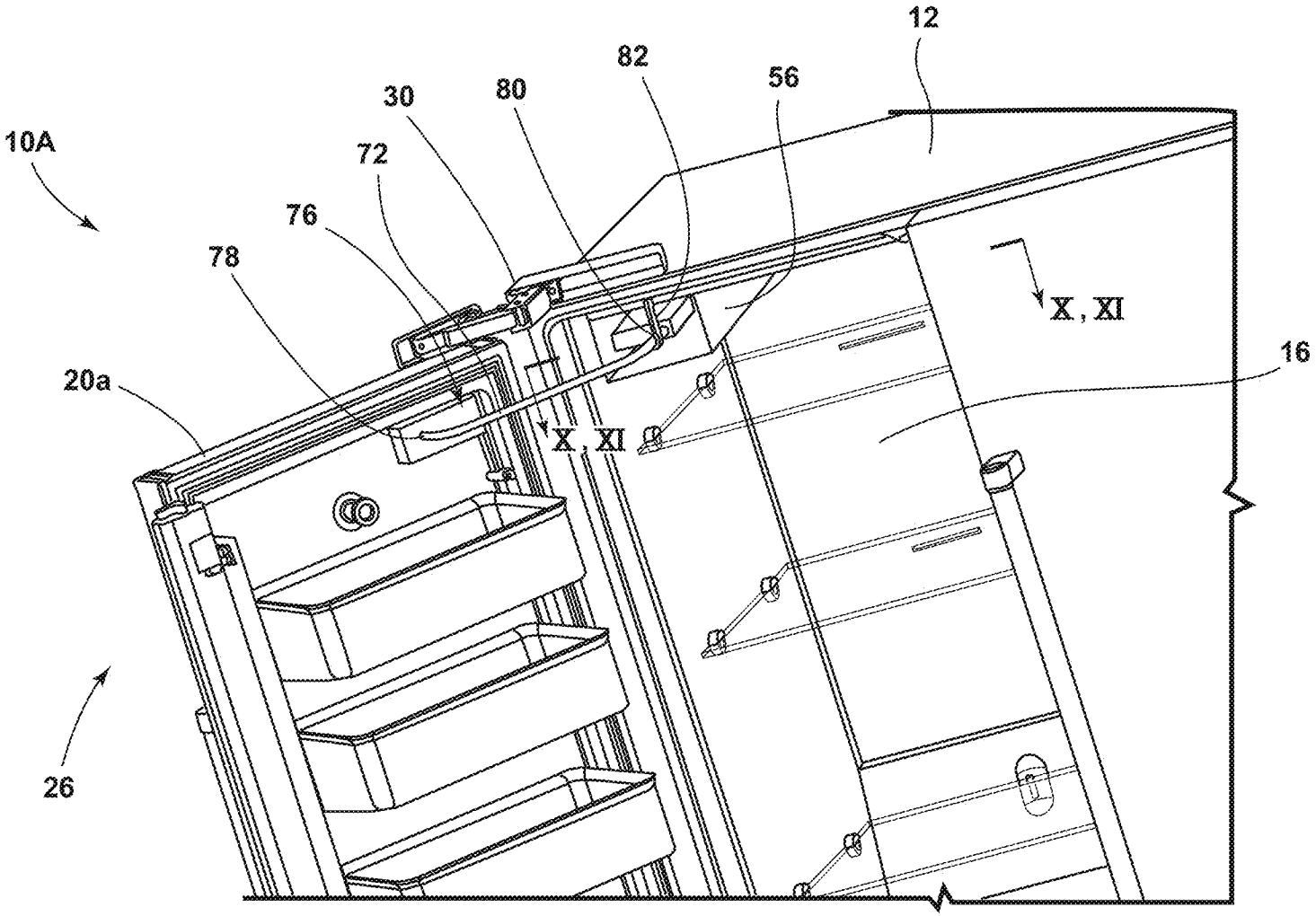
FIG. 9 is a perspective close up view of another embodiment of a refrigerator of this disclosure, illustrating the door in the opened position relative to the cabinet and a liquid line in a stretched state extending from the cabinet to the door, in order to transport liquid from the cabinet to the door for use with the dispensing apparatus.

Referring now additionally to FIGS. 7 and 8, to solve that problem and to bridge the liquid transfer gap between the tubing 48 within the cabinet 12 (or the cabinet 12 generally) and the door 20*a*, the cabinet 12 further includes a liquid outlet 52 and the door 20*a* further includes a liquid receiver 54. The liquid outlet 52 is in liquid communication with the tank 44 via the tubing 48. As mentioned above, the one-way valve 50 disposed in liquid communication between the tank 44 and the liquid outlet 52 permits liquid flow only toward the liquid outlet 52 from the tank 44. The liquid outlet 52 can be disposed within the fresh food compartment 16 and partially hidden by a false wall 56 (such as a plastic or metal component). The false wall 56 also conceals via covering a portion of the tubing 48 in communication with and adjacent to the liquid outlet 52. As illustrated in FIG. 7, when the door 20*a* is in the opened position 26, the liquid receiver 54 is not configured to receive liquid exiting (e.g., ejected from) the liquid outlet 52—the liquid receiver 54 is not lined up with the liquid outlet 52 in the direction of liquid flow and the liquid ejected from the liquid outlet 52 would splash against the door 20*a* or cascade to the floor. However, as illustrated in FIG. 8, when the door 20*a* is in the closed position 22, the liquid receiver 54 is lined up with the liquid outlet 52 in the direction of liquid flow and is thus configured to receive liquid exiting (i.e., ejected from) the liquid outlet 52. In the illustrated embodiment, the liquid receiver 54 is disposed vertically below the liquid outlet 52 of the cabinet 12 while the door 20*a* is in the closed position 22. However, the liquid receiver 54 could be positioned elsewhere relative to the liquid outlet 52 as long as the direction of liquid flow from the liquid outlet 52 would enter the liquid receiver 54. The cabinet 12 further includes a gasket 58 cooperating with, such as encircling and being adjacent to, the liquid outlet 52. The door 20*a* further includes a gasket 60 cooperating with, such as encircling and being adjacent to, the liquid receiver 54. When the door 20*a* is in the closed position 22, the gasket 60 of the door 20*a* cooperates with, such as abutting against, the gasket 58 of the cabinet 12 to form a sealed channel 62 extending through both the gasket 58 of the cabinet 12 and the gasket 60 of the door 20*a*. Because of the sealed channel 62, liquid exiting the liquid outlet 52 is received only by the liquid receiver 54. In the illustrated embodiment, the gasket 60 of the door 20*a* cooperating with the liquid receiver 54 is disposed vertically below the gasket 58 of the cabinet 12 cooperating with the liquid outlet 52, when the door 20*a* is in the closed position 22. When the door 20*a* is in the closed position 22, the gasket 58 of the cabinet 12 can deform the gasket 60 of the door 20*a* and vice-versa. However, as the door 20*a* transitions from the closed position 22 to the opened position 26, the gasket 60 of the door 20*a* slides against the gasket 58 of the cabinet 12, the sealed channel 62 loses form, and eventually the gaskets 58, 60 separate and no longer cooperate.

The liquid that the liquid receiver 54 receives can then be utilized by the ice maker 40 at the door 20*a* and the liquid dispenser 36, which is in communication with the liquid receiver 54 and configured to dispense liquid received from the liquid receiver 54. The door 20*a* can include a reservoir 64 in communication with the liquid receiver 54 that collects liquid expelled from the liquid outlet 52 of the cabinet 12. The reservoir 64 allows for an amount of liquid that will eventually be dispensed by the dispenser assembly 34 in either liquid or ice form to be stored within the door 20*a*, and compensates for variations in liquid flow from the liquid outlet 52. The door 20*a* can further include a pump 66 in communication with the reservoir 64 and the liquid receiver 54, to transport liquid received by the liquid receiver 54 and collected in the reservoir 64 to and through the liquid dispenser 36 or to the ice maker 40 in the door 20*a*. The door 20*a* can include a valve in communication with the reservoir 64 to prevent the creation of suction drawing material into the reservoir through the liquid receiver 54 when the door 20*a* is in the opened position 26. The door 20*a* can further include a filter 68 in communication with the liquid receiver 54 that filters the liquid that the liquid receiver 54 receives from the liquid outlet 52 of the cabinet 12. The filter 68 can be downstream from the pump 66. The pump 66 can provide sufficient pressure to transport the liquid through the filter 68. The door 20*a* can further include a valve 70 in communication with the liquid receiver 54, such as downstream of the filter 68 that selectively diverts liquid received by the liquid receiver 54 to either the ice maker 40 in the door 20*a* or the liquid dispenser 36. The liquid dispenser 36 can thus dispense liquid filtered by the filter 68 after being received by the liquid receiver 54 from the liquid outlet 52, and the ice maker 40 can thus make ice from liquid filtered by the filter 68 after being received by the liquid receiver 54 from the liquid outlet 52. The pump 66 can further control the flow rate of liquid through the liquid dispenser 36, such as to achieve the flow rate through the liquid dispenser 36 that the user commands via the dispenser assembly 34.

The gasket 58 and the gasket 60 can each include a mesh component covering at least the inner diameter of the gasket in order to prevent dust and other material from entering into the reservoir 64 or behind the false wall 56 when the door 20*a* is in the opened position 26. To further maintain the sanitation of the reservoir 64, the door 20*a* can include a UV light module in light communication with (e.g., adjacent to) the reservoir 64. Additionally, or as an alternative, the reservoir 64 can be releasably attached to the door 20*a*, to allow the user to remove the reservoir 64 for sanitization.

Referring now to FIGS. 9-12, an alternative embodiment of a refrigerator 10A again includes the cabinet 12 and the door 20*a* operably connected to the cabinet 12. Again, one or more articulated hinges 30 can form the operable connection between the door 20*a* and the cabinet 12, and the articulated hinges 30 move the door 20*a* away from the cabinet 12 as the door 20*a* transitions from the closed position 22 (FIG. 10) to the opened position 26 (FIG. 9) relative to the cabinet 12. In this alternative embodiment, instead of the liquid outlet 52 and the liquid receiver 54 of the refrigerator 10 to transport liquid from the cabinet 12 to the door 20*a*, the refrigerator 10A utilizes a liquid line 72 to transport liquid from the cabinet 12 to the door 20*a*. The liquid line 72 is stretchable from a relaxed state 74 (FIG. 10) when the door 20*a* is in the closed position 22 to a stretched state 76 when the door 20*a* is in the opened position 26. In other words, the liquid line 72 is longer in the stretched state 76 than in the relaxed state 74, allowing liquid to be transported from the cabinet 12 to the door 20*a* despite the articulated hinge 30 moving the door 20*a* away from the cabinet 12 while the door 20*a* is moving to the opened position 26. The liquid line 72 can stretch to be twice as long in the stretched state 76 than in the relaxed state 74. The liquid line 72 transforms from the relaxed state 74 into the stretched state 76 as the door 20*a* moves from the closed position 22 to the opened position 26. The liquid line 72 transforms from the stretched state 76 into the relaxed state 74 as the door 20*a* moves from the opened position 26 to the closed position 22.

Figure 10:
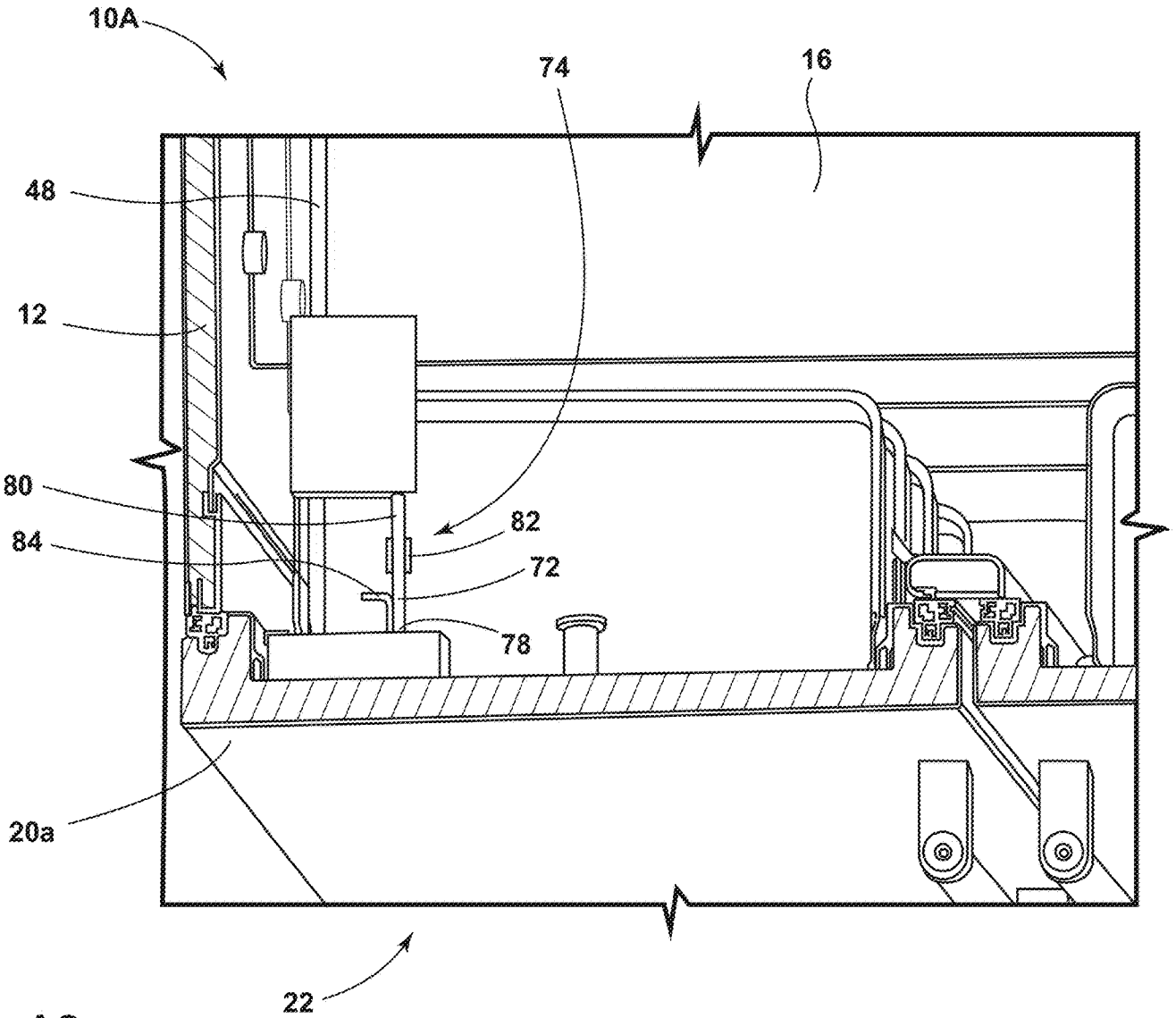
FIG. 10 is a close up cross-sectional top view of the refrigerator of FIG. 9 taken along line X-X of FIG. 9, illustrating the liquid line in a relaxed state when the door is in the closed position, and the liquid line being shorter in length in the relaxed state than in the stretched state.
Figure 11:
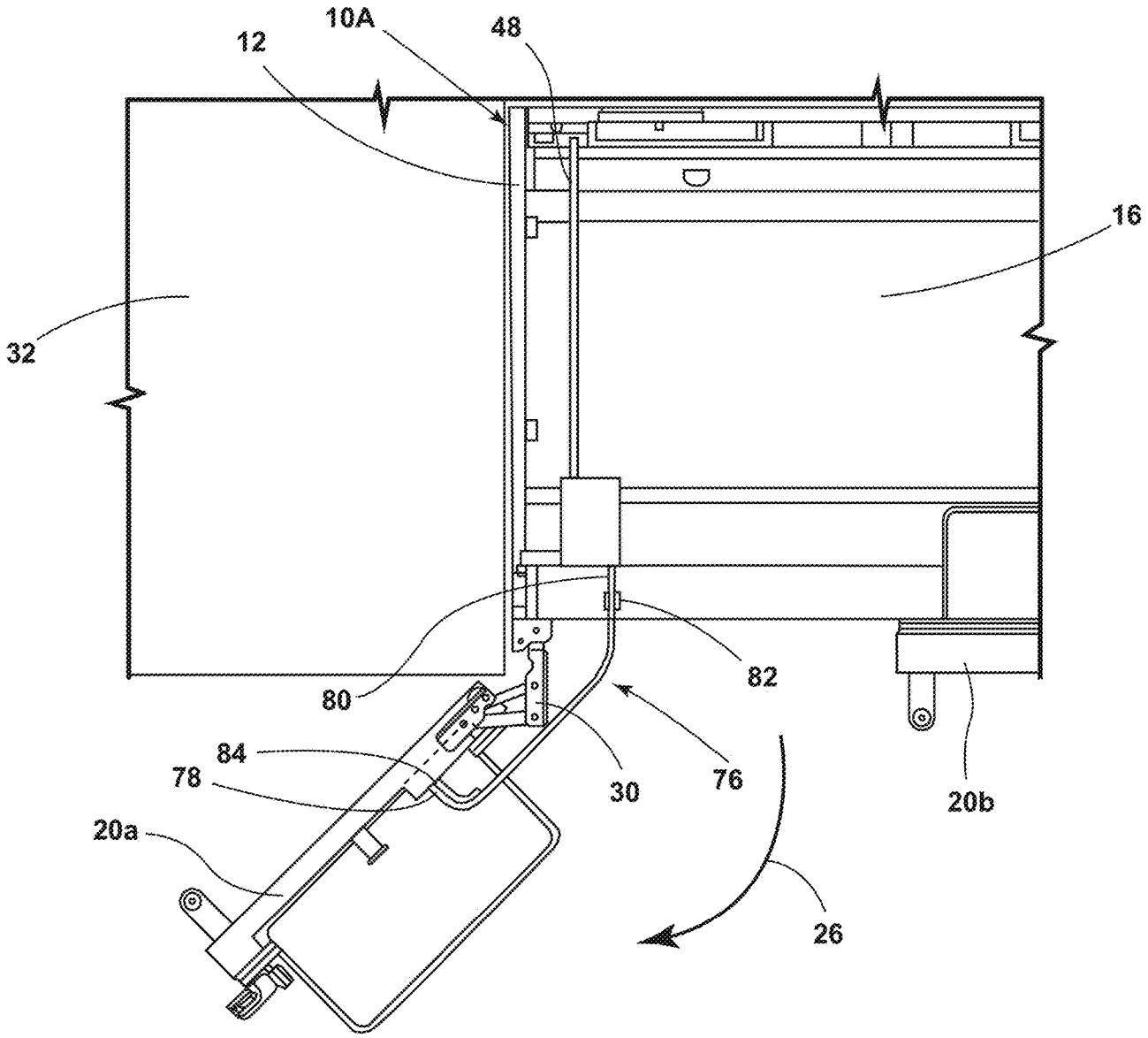
FIG. 11 is a cross-sectional top view of the refrigerator of FIG. 9 taken along line XI-XI of FIG. 9, illustrating the liquid line in the longer stretched state when the door is in the opened position and the articulated hinge has pushed the door away from the cabinet so as to not interfere with the adjacent cabinetry.
Figure 12:
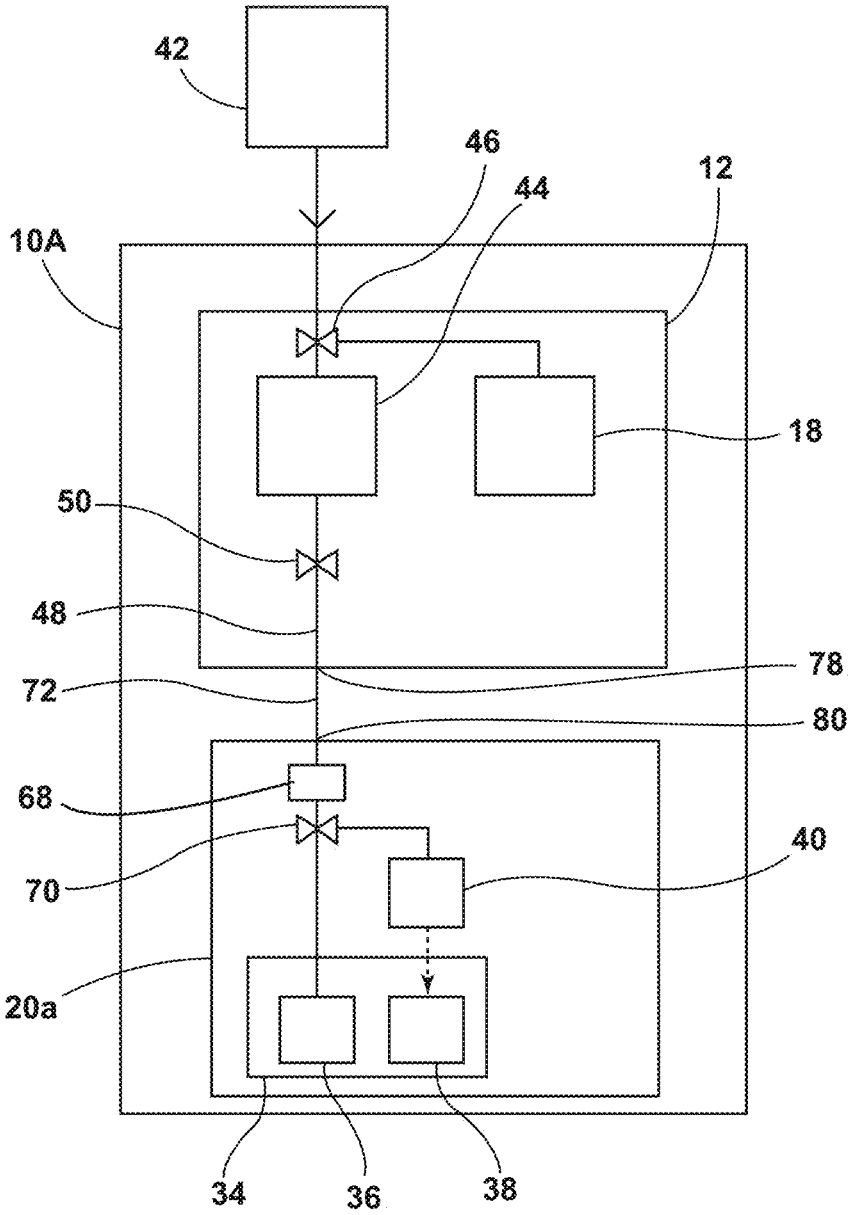
FIG. 12 is a schematic diagram of liquid flow from the source external to the refrigerator of FIG. 9, through the cabinet to the liquid line at the cabinet, through the liquid line and to the door, and through the door to the dispensing apparatus.
Figure 13:
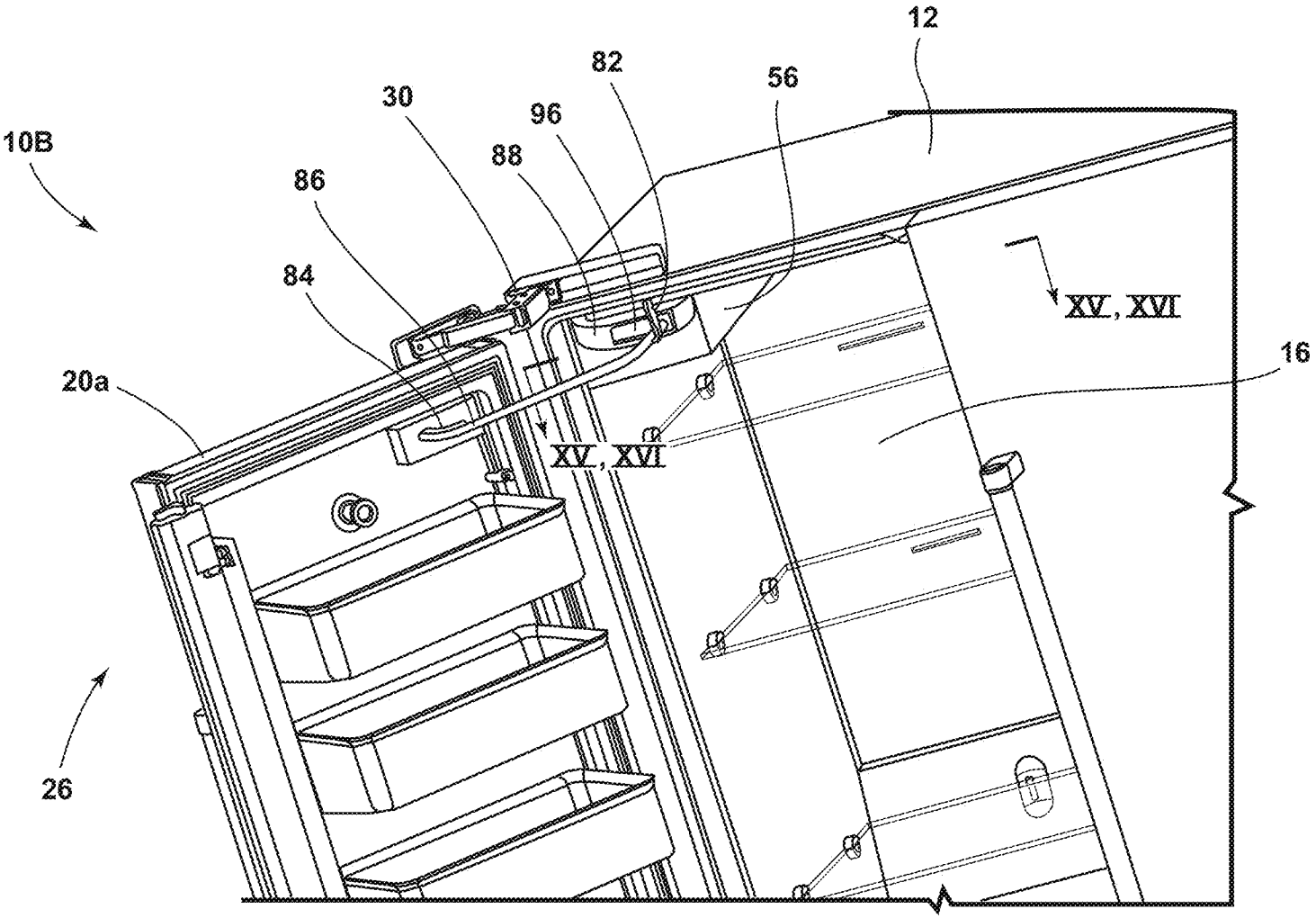
FIG. 13 is a perspective close up view of another embodiment of a refrigerator of this disclosure, illustrating the door in the opened position relative to the cabinet and a liquid line extending from the cabinet to the door with a released portion released from a retractor at the cabinet, in order to transport liquid from the cabinet to the door for use with the dispensing apparatus.
Figure 14:
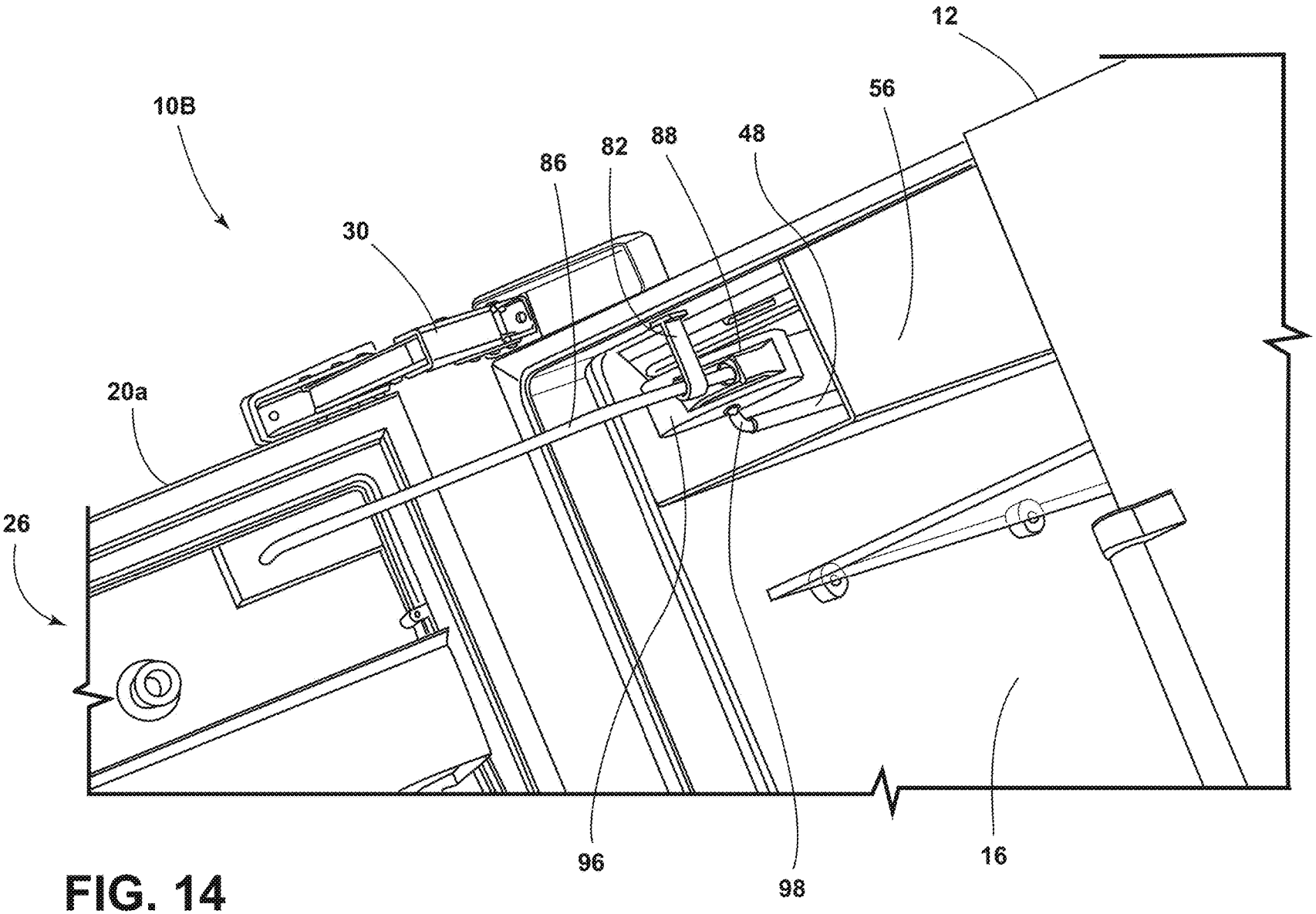
FIG. 14 is a perspective close up view of the refrigerator of FIG. 13, illustrating the door in the opened position and the released portion of the liquid line released from the retractor at the cabinet, a guide at the cabinet guiding the liquid line, and a liquid inlet into the retractor in communication with the liquid line.
Figure 15:
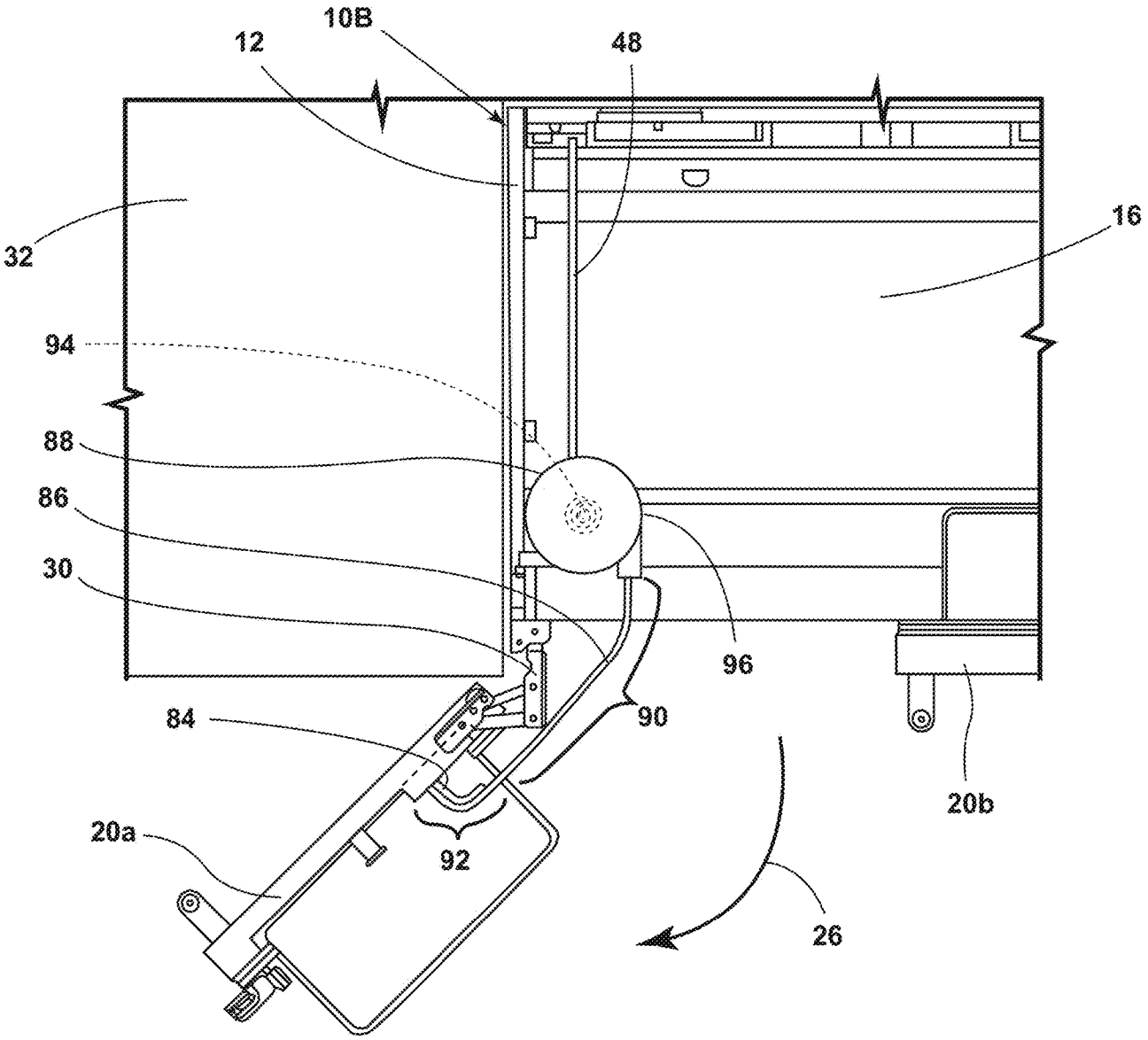
FIG. 15 is an overhead view of the refrigerator of FIG. 13 with the top of the cabinet in phantom, illustrating a guide at the door guiding the liquid line when the door is in the opened position and a recoil spring in the retractor applying a retracting force to the liquid line such that when the door moves to the closed position, the released portion of the liquid line retracts back into the retractor.
Figure 16:
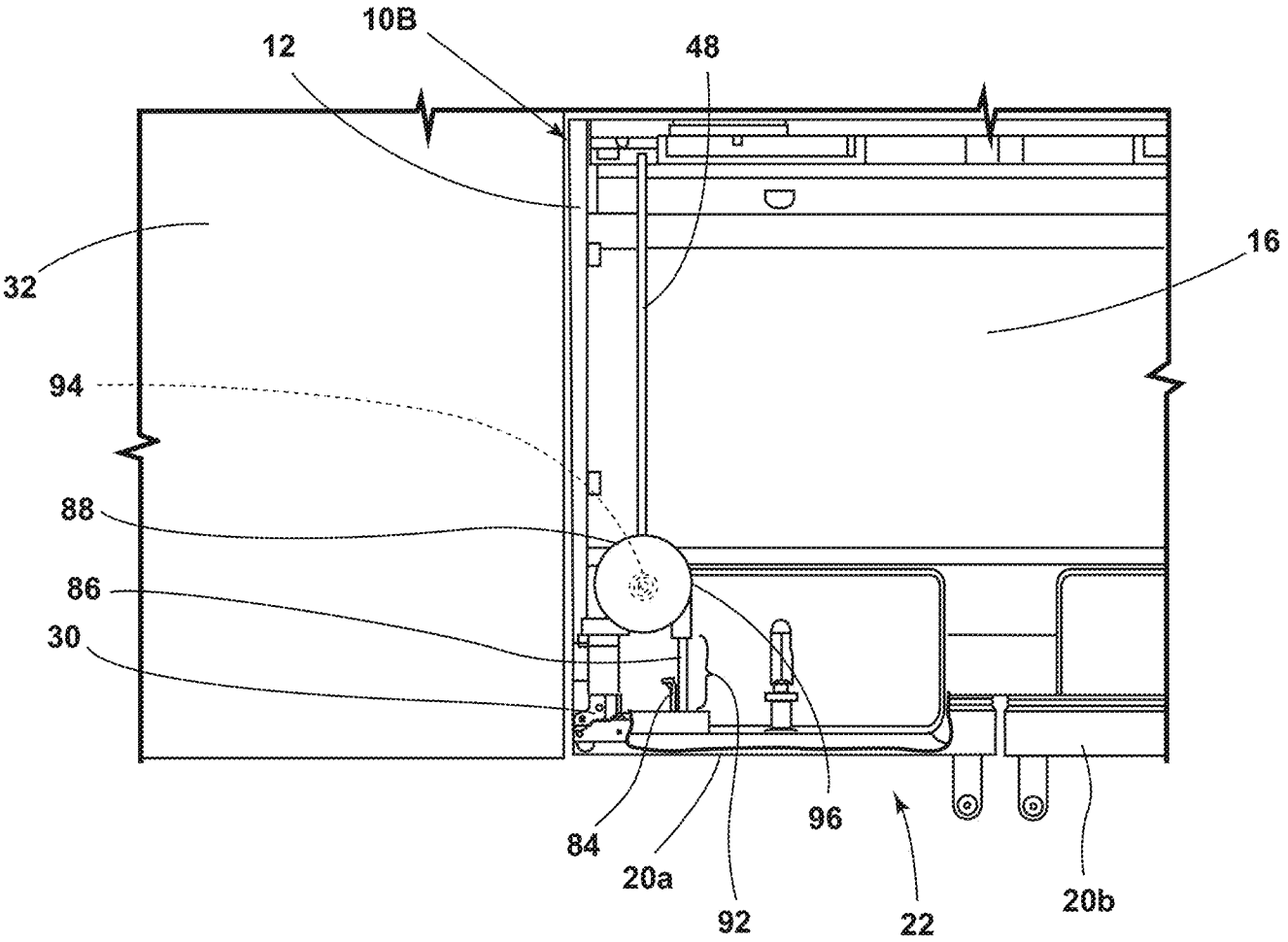
FIG. 16 is an overhead view of the refrigerator of FIG. 13 with the top of the cabinet in phantom, illustrating the door in the closed position and the retractor having retracted the released portion of the liquid line back into the retractor due to the retraction force of the recoil spring, such that only an exposed portion of the liquid line remains outside of a housing of the retractor.
Figure 17:
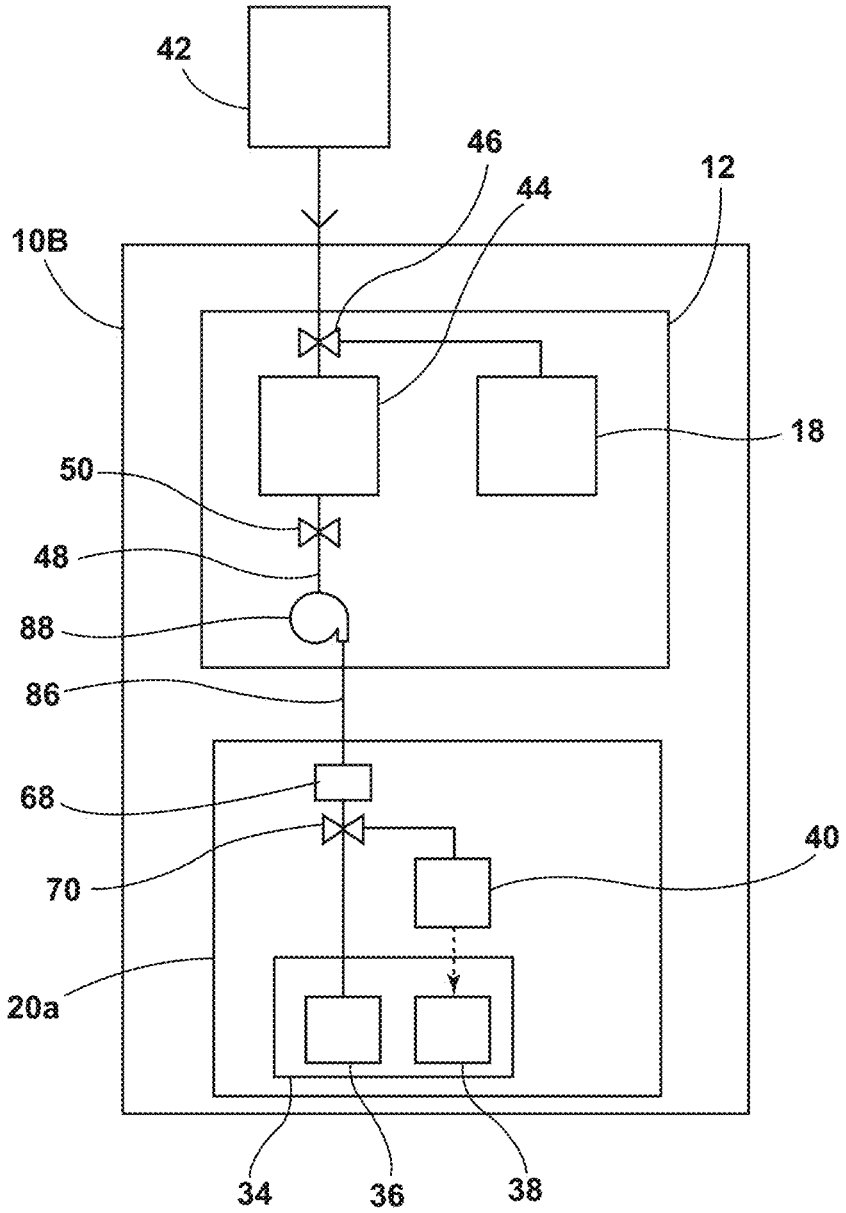
FIG. 17 is a schematic diagram of flow from the source external to the refrigerator of FIG. 13, through the cabinet to the retractor at the cabinet and into the liquid line at the cabinet, through the liquid line and to the door, and through the door to the dispensing apparatus.

The liquid line 72 includes a door portion 78 disposed at the door 20*a* and a cabinet portion 80 disposed at the cabinet 12. The cabinet portion 80 of the liquid line 72 can be disposed within the fresh food compartment 16. In the illustrated embodiment, the cabinet portion 80 of the liquid line 72 is at the same level as the door portion 78 (i.e., at the same height from the ground, assuming level ground). As illustrated in FIG. 10, when the door 20*a* is in the closed position 22, the liquid line 72 is disposed in a linear path between the cabinet portion 80 and the door portion 78. The false wall 56 can cover at least a portion of the cabinet portion 80 of the liquid line 72, so as to hide some of the liquid line 72 from view. The cabinet 12 can include a guide 82 and the door 20*a* can include a guide 84 to guide the liquid line 72. The guides 82, 84 help to prevent the liquid line 72 from crimping in the stretched state 76 and guide the liquid line 72 back to the original position in the relaxed state 74.

The refrigerator 10A can otherwise include the described above features of the refrigerator 10. The door 20*a* can include the liquid dispenser 36, which is in communication with the liquid line 72 and configured to dispense liquid from the door 20*a* while the door 20*a* is in the closed position 22. The liquid can be dispensed from the liquid dispenser 36 upon command from the user. The cabinet 12 can further include the tank 44 that stores liquid received from the source 42 external to the refrigerator 10A. The liquid line 72 can then be in communication with the liquid tank 44. The cabinet 12 can further include the freezer compartment and the ice maker 18 in the freezer compartment 14. The valve 46 selectively diverts liquid received from the source 42 external to the refrigerator 10A, and transported from the cabinet 12 to the door 20*a* by the liquid line 72, to either the tank 44 or the ice maker 18 in the freezer compartment 14. The cabinet 12 can further include the one-way valve 50 between the tank 44 and the liquid line 72 between the door 20*a* and the cabinet 12, to permit liquid flow only toward the liquid line 72 from the tank 44. The door 20*a* can include the filter 68 in communication with the liquid line 72 that filters the liquid that the liquid line 72 transports to the door 20*a*. The door 20*a* further includes the dispensing apparatus 34 with the liquid dispenser 36. The liquid dispenser 36 dispenses liquid transported by the liquid line 72, including liquid filtered by the filter 68 if present. The door 20*a* can further include the ice maker 40 that makes ice from liquid transported by the liquid line 72, including liquid filtered by the filter 68 if present. The door 20*a* can further include the valve 70 between the liquid line 72 (or the filter 68 if present) and both the ice maker 40 and the liquid dispenser 36, and the valve 70 selectively diverts liquid to either the ice maker 40 or the liquid dispenser 36. In addition, the valve 70 prevents liquid from gushing out of the liquid dispenser 36 when the door 20*a* opens, for example, because of the liquid line 72 decreasing in internal volume, as the liquid line 72 would upon changing from the relaxed state 74 to the stretched state 76 without the valve 70.

Referring now to FIGS. 13-17, yet another alternative embodiment of a refrigerator 10B again includes the cabinet 12 and the door 20*a* operably connected to the cabinet 12. Again, one or more articulated hinges 30 can form the operable connection between the door 20*a* and the cabinet 12, and the articulated hinges 30 move the door away from the cabinet 12 as the door transitions from the closed position 22 (FIG. 16) to the opened position 26 (FIG. 15) relative to the cabinet 12. In this alternative embodiment, instead of incorporating the liquid outlet 52 and the liquid receiver 54 of the refrigerator 10 to transport liquid from the cabinet 12 to the door 20*a*, the refrigerator 10B utilizes a liquid line 86 to transport liquid from the cabinet 12 to the door 20*a*. The refrigerator 10B further includes a retractor 88. The retractor 88 is fixed within the cabinet 12 and operably coupled to the liquid line 86. The retractor 88 releases a released portion 90 (see FIG. 15) of the liquid line 86 when the door 20*a* moves from the closed position 22 to the opened position 26. The retractor 88 retracts the released portion 90 of the liquid line 86 when the door 20*a* moves from the opened position 26 to the closed position 22. The liquid line 86 has an exposed portion 92 between the door 20*a* and the retractor 88, which the retractor 88 does not retract into the retractor 88, when the door 20*a* is in the closed position 22.

The retractor 88 includes a recoil spring 94 (see FIG. 15) that imparts a retracting force upon the liquid line 86. Movement of the door 20*a* from the closed position 22 to the opened position 26 imparts a pulling force on the liquid line 86, sufficient to overcome the retracting force from the recoil spring 94, that extracts the released portion 90 of the liquid line 86 from the retractor 88. Because the recoil spring 94 imparts the retracting force upon the liquid line 86, when the door 20*a* moves toward the closed position 22 from the opened position 26, the released portion 90 of the liquid line 86 retracts. The retractor 88 further includes a housing 96. The housing 96 houses and supports the recoil spring 94. The housing 96 houses the released portion 90 of the liquid line 86 when the liquid line 86 is retracted as the door 20*a* moves from the opened position 26 to the closed position 22. The housing 96 further includes an inlet 98 in communication with the tubing 48. Liquid flows through the tubing 48 and into the inlet 98 of the housing 96. The liquid line 86 is in fluid communication with the inlet 98 of the housing 96. Thus, liquid flows from the inlet 98 of the housing 96 into and through the liquid line 86.

In the illustrated embodiment, the released portion 90 of the liquid line 86 that is released from the retractor 88 when the door 20*a* moves from the closed position 22 to the opened position 26 is at least twice as long as the exposed portion 92 of the liquid line 86 when the door 20*a* is in the closed position 22. In the illustrated embodiment, the retractor 88 is disposed within the fresh food compartment 16 of the cabinet 12, with the false wall 56 covering and concealing the retractor 88 from view. However, the retractor 88 could be alternatively disposed at the door 20*a*. When the door 20*a* is in the closed position 22, the liquid line 86 is disposed in a linear path between the door 20*a* and the retractor 88. The cabinet 12 and the door 20*a* each include the guides 82, 84, respectively, that engage the liquid line 86 to prevent crimping as the door 20*a* moves to the opened position 26 and to guide the liquid line 86 as the retractor 88 retracts the liquid line 86 when the door 20*a* moves to the closed position 22.

The refrigerator 10B can otherwise include the described above features of the refrigerator 10. The door 20*a* can include the liquid dispenser 36, which is in communication with the liquid line 86 and configured to dispense liquid from the door 20*a* while the door 20*a* is in the closed position 22. The liquid can be dispensed from the liquid dispenser 36 upon command from the user. The cabinet 12 can further include the tank 44 that stores liquid received from the source 42 external to the refrigerator 10B. The liquid line 86 can then be in communication with the tank 44. The cabinet 12 can further include the freezer compartment 14 and the ice maker 18 in the freezer compartment 14. The valve 46 selectively diverts liquid received from the source 42 external to the refrigerator 10B, and transported from the cabinet 12 to the door 20*a* by the liquid line 86, to either the tank 44 or the ice maker 18 in the freezer compartment 14. The cabinet 12 can further include the one-way valve 50 between the tank 44 and the liquid line 86 between the door 20*a* and the cabinet 12, to permit liquid flow only toward the liquid line 86 from the tank 44. The door 20*a* can include the filter 68 in communication with the liquid line 86 that filters the liquid that the liquid line 86 transports to the door 20*a*. The door 20*a* further includes the dispensing apparatus 34 with the liquid dispenser 36. The liquid dispenser 36 dispenses liquid transported by the liquid line 86, including liquid filtered by the filter 68 if present. The door 20*a* can further include the ice maker 40 that makes ice from liquid transported by the liquid line 86, including liquid filtered by the filter 68 if present. The door 20*a* can further include the valve 70 between the liquid line 86 (or the filter 68 if present) and both the ice maker 40 and the liquid dispenser 36, and the valve 70 selectively diverts liquid to either the ice maker 40 or the liquid dispenser 36.

The utilization of the cooperating liquid outlet 52 and liquid receiver 54 in refrigerator 10, the stretchable liquid line 72 in refrigerator 10A, and the retractable liquid line 86 in refrigerator 10B all solve the problem of not being able to transport liquid (such as water) through normal tubing in a refrigerator from a cabinet 12 to a door 20*a* when the door is moved from the closed position 22 to the opened position 26 in a non-circular manner such as when an articulated hinge 30 is used to push the door 20*a* away from the cabinet 12. The solutions presented may be particularly useful for counter depth refrigeration products that utilize a hinge, such as the articulated hinge 30, that allows the door 20*a* to transition to the opened position 26 in a non-circular manner.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A refrigerator comprising:

a cabinet;

a door operably connected to the cabinet, the door having a closed position relative to the cabinet and an opened position relative to the cabinet, wherein the door transitions from the closed position to the opened position in a non-circular path;

a liquid line configured to transport liquid from the cabinet to the door; and a retractor fixed within the cabinet or disposed at the door, the retractor comprising a housing, the retractor operably coupled to the liquid line that releases a released portion of the liquid line from the housing when the door moves from the closed position to the opened position and retracts the released portion of the liquid line into the housing when the door moves from the opened position to the closed position, the liquid line having an exposed portion between the door and the housing of the retractor when the door is in the closed position.

2. The refrigerator of claim 1 further comprising:

one or more articulated hinges that operably connect the door to the cabinet, the one or more articulated hinges defining the non-circular path in which the door opens.

3. The refrigerator of claim 2, wherein the one or more articulated hinges move the door away from the cabinet when the door transitions from the closed position to the opened position.

4. The refrigerator of claim 1, wherein the retractor is fixed within the cabinet.

5. The refrigerator of claim 1, wherein the released portion of the liquid line that is released from the retractor when the door moves from the closed position to the opened position is at least twice as long as the exposed portion of the liquid line when the door is in the closed position.

6. The refrigerator of claim 1, wherein movement of the door from the closed position to the opened position imparts a pulling force extracting the released portion of the liquid line from the retractor.

7. The refrigerator of claim 1, wherein the retractor comprises a recoil spring housed within the housing that imparts a retracting force upon the liquid line, such that when the door moves toward the closed position, the released portion of the liquid line retracts into the housing.

8. The refrigerator of claim 7, wherein movement of the door from the closed position to the opened position imparts a pulling force on the liquid line that is sufficient to overcome the retracting force from the recoil spring and extracts the released portion of the liquid line from the retractor.

9. The refrigerator of claim 1, wherein the housing comprises an inlet in communication with tubing, with the tubing, inlet, and liquid line configured to permit the liquid to flow through the tubing, into the inlet of the housing, and subsequently to the liquid line.

10. The refrigerator of claim 1, wherein when the door is in the closed position, the liquid line is disposed in a linear path between the door and the retractor.

11. The refrigerator of claim 1, wherein the cabinet includes a guide that guides the liquid line when the door moves between the closed position and the opened position.

12. The refrigerator of claim 1, wherein the cabinet comprises a tank that stores liquid received from a source external to the refrigerator, and the liquid line is in communication with the tank.

13. The refrigerator of claim 12, wherein the cabinet comprises (i) a freezer compartment, (ii) an ice maker in the freezer compartment, and (iii) a valve that selectively diverts liquid received from the source external to the refrigerator to either the tank or the ice maker in the freezer compartment.

14. The refrigerator of claim 12, wherein the cabinet further comprises a one-way valve between the tank and the liquid line, the one-way valve permitting liquid flow only toward the liquid line from the tank.

15. The refrigerator of claim 1, wherein the cabinet comprises a fresh food compartment, the door allows access into the fresh food compartment when the door is in the opened position, and the retractor is disposed within the fresh food compartment.

16. The refrigerator of claim 1, wherein the door comprises a filter in communication with the liquid line that filters the liquid that the liquid line transports to the door.

17. The refrigerator of claim 16, wherein the door further comprises an ice maker that makes ice from liquid filtered by the filter.

18. The refrigerator of claim 16, wherein the door further comprises a liquid dispenser that dispenses liquid filtered by the filter.

19. The refrigerator of claim 18, wherein the liquid dispenser is configured to dispense liquid from the door while the door is in the closed position and upon command from a user.

20. The refrigerator of claim 16, wherein the door further comprises a valve disposed in communication between the filter and both an ice maker and a liquid dispenser that selectively diverts liquid to either the ice maker or the liquid dispenser.

* * * * *